US008833468B2

(12) United States Patent
Swan

(10) Patent No.: US 8,833,468 B2
(45) **Date of Patent: *Sep. 16, 2014**

(54) CIRCULATION CONTROL VALVE AND ASSOCIATED METHOD

(75) Inventor: Tom Swan, Parker, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 574 days.

This patent is subject to a terminal disclaimer.

(21) Appl. No.: 12/398,151

(22) Filed: Mar. 4, 2009

(65) Prior Publication Data

US 2010/0224371 A1 Sep. 9, 2010

(51) Int. Cl.

| | |
|---|---|
| ***E21B 34/06*** | (2006.01) |
| ***E21B 34/10*** | (2006.01) |
| ***E21B 23/04*** | (2006.01) |
| ***E21B 21/10*** | (2006.01) |
| *E21B 34/00* | (2006.01) |

(52) U.S. Cl.

CPC ..... *E21B 34/10* (2013.01); *E21B 23/04* (2013.01); *E21B 2034/007* (2013.01); *E21B 21/103* (2013.01)

USPC ..... 166/373; 166/386

(58) Field of Classification Search

USPC ..... 166/373, 386, 321, 332.4

See application file for complete search history.

(56) References Cited

U.S. PATENT DOCUMENTS

| | | | | |
|---|---|---|---|---|
| 3,410,346 A | * | 11/1968 | Garrett et al. | 166/53 |
| 3,823,773 A | * | 7/1974 | Nutter | 166/336 |
| 4,403,659 A | | 9/1983 | Upchurch | |
| 4,429,747 A | | 2/1984 | Williamson, Jr. | |
| 4,513,764 A | | 4/1985 | Yonker | |
| 4,657,082 A | | 4/1987 | Ringgenberg | |
| 4,913,231 A | | 4/1990 | Muller et al. | |
| 5,020,592 A | | 6/1991 | Muller et al. | |
| 5,499,687 A | | 3/1996 | Lee | |

(Continued)

FOREIGN PATENT DOCUMENTS

| | | | |
|---|---|---|---|
| CN | 2585971 | Y | 11/2003 |
| CN | 200982181 | Y | 11/2007 |
| WO | 9736089 | A1 | 10/1997 |
| WO | 9747850 | A1 | 12/1997 |

OTHER PUBLICATIONS

International Search Report and Written Opinion issued Dec. 5, 2008, for International Application Serial No. PCT/US08/79158, 8 pages.

(Continued)

*Primary Examiner* — Kenneth L Thompson
*Assistant Examiner* — Catherine Loikith
(74) *Attorney, Agent, or Firm* — Smith IP Services, P.C.

(57) ABSTRACT

A method of controlling flow between a flow passage of a tubular string and an annulus includes: constructing a valve having an opening for flow between the passage and annulus; permitting flow through the opening; then preventing flow through the opening in response to applying pressure to the valve; and then mechanically displacing a closure device, thereby allowing flow through the opening. Another method includes applying a pressure differential across a piston of a valve, thereby displacing a closure device; and then displacing the closure device relative to the piston, thereby allowing flow between the passage and the annulus. A valve includes an opening for flow between an interior and exterior of the valve, a closure device for permitting and preventing flow through the opening, and a piston which biases the closure device to displace, the closure device being mechanically displaceable relative to the piston.

19 Claims, 40 Drawing Sheets

(56) References Cited

U.S. PATENT DOCUMENTS

| | | | | |
|---|---|---|---|---|
| 5,529,126 | A | 6/1996 | Edwards | |
| 5,609,178 | A | 3/1997 | Hennig et al. | |
| 5,819,853 | A * | 10/1998 | Patel | 166/373 |
| 6,102,126 | A | 8/2000 | Huber et al. | |
| 6,173,795 | B1 | 1/2001 | McGarian et al. | |
| 6,397,949 | B1 | 6/2002 | Walker et al. | |
| 6,439,306 | B1 | 8/2002 | Patel | |
| 6,464,008 | B1 * | 10/2002 | Roddy et al. | 166/285 |
| 7,063,152 | B2 | 6/2006 | Yeo et al. | |
| 7,069,992 | B2 | 7/2006 | Lewis et al. | |
| 7,108,071 | B2 | 9/2006 | Freiheit et al. | |
| 7,373,980 | B2 | 5/2008 | Lewis et al. | |
| 2004/0020657 | A1 * | 2/2004 | Patel | 166/373 |
| 2005/0263279 | A1 | 12/2005 | Vachon | |
| 2007/0029078 | A1 | 2/2007 | Wright et al. | |
| 2007/0119594 | A1 | 5/2007 | Turner et al. | |
| 2009/0095463 | A1 * | 4/2009 | Swan et al. | 166/53 |
| 2009/0095486 | A1 | 4/2009 | Williamson, Jr. | |

OTHER PUBLICATIONS

International Search Report and Written Opinion issued Dec. 5, 2008, for International Application Serial No. PCT/US08/79187, 7 pages.

BJ Services Company TIP-PT Packer product brochure, Mar. 12, 2003, 1 page.

Halliburton H03877 FracDoor™ Sliding Side-Door® Circulation and Production Sleeve product brochure, Feb. 2006, 2 pages.

Halliburton Tubing-Installed Flow Control Equipment product brochure, undated, 3 pages.

Halliburton Drawing No. 531CV27509, Circulating Control Valve Assembly, Jun. 28, 1997, 18 pages.

International Search Report and Written Opinion issued Oct. 8, 2010, for International Application Serial No. PCT/US10/025511, 8 pages.

International Preliminary Report on Patentability issued Sep. 15, 2011 for International Patent Application No. PCT/US10/025511, 5 pages.

Chinese Search Report issued Aug. 23, 2013 for Chinese Patent Application No. 201080008950.9, 2 pages.

Chinese Office Action issued Sep. 3, 2013 for Chinese Patent Application No. 201080008950.9, 8 pages.

Office Action issued Apr. 25, 2014 for Chinese Patent Application No. 201080008950.9, 5 pages.

English translation of Office Action issued Apr. 25, 2014 for Chinese Patent Application No. 201080008950.9, 11 pages.

English abstract for Chinese Publication No. CN 2585971 Y retrieved Apr. 15, 2014 from http://worldwide.espacenet.com/searchResults?compact=false&PN=CN2585971Y&ST=advanced&locale=en_EP&DB=EPODOC.

English abstract for Chinese Publication No. CN 200982181 Y retrieved Apr. 15, 2014 from http://worldwide.espacenet.com/searchResults?compact=false&PN=CN200982181Y&ST=advanced&locale=en_EP&DB=EPODOC.

* cited by examiner

CIRCULATION CONTROL VALVE AND ASSOCIATED METHOD

BACKGROUND

The present disclosure relates generally to equipment utilized and operations performed in conjunction with a subterranean well and, in an embodiment described herein, more particularly provides a circulation control valve and associated method.

It is frequently beneficial to be able to selectively permit and prevent circulation flow through a sidewall of a tubular string in a well. For example, at the conclusion of a cementing operation, in which the tubular string has been cemented in the well, it is sometimes desirable to circulate cement out of a portion of an annulus exterior to the tubular string. As another example, in staged cementing operations it may be desirable to flow cement through sidewall openings in a tubular string. Numerous other examples exist, as well.

Although circulation control valves for these purposes have been used in the past, they have not been entirely satisfactory in their performance. Therefore, it may be seen that improvements are needed in the art of circulation control valves and associated methods.

SUMMARY

In the present specification, a circulation control valve is provided which solves at least one problem in the art. One example is described below in which valve devices are used to control opening and closing of a valve in response to pressure applied thereto. Another example is described below in which a closure device of the valve can be mechanically operated after pressure operation.

In one aspect, a method of controlling flow between an interior flow passage of a tubular string and an annulus external to the tubular string in a subterranean well is provided. The method includes the steps of: constructing a valve for interconnection in the tubular string, the valve including at least one opening for providing fluid communication between the interior flow passage and the annulus; permitting fluid communication through the opening between the interior flow passage and the annulus; then preventing fluid communication through the opening between the interior flow passage and the annulus in response to an application of pressure to the valve; and then mechanically displacing a closure device of the valve, thereby allowing fluid communication through the opening between the interior flow passage and the annulus.

In another aspect, a method of controlling flow between an interior flow passage of a tubular string and an annulus external to the tubular string in a subterranean well includes the steps of: applying a pressure differential across a piston of a valve interconnected in the tubular string, thereby displacing a closure device of the valve; and then displacing the closure device relative to the piston, thereby allowing fluid communication between the flow passage and the annulus via at least one opening of the valve.

In yet another aspect, a valve for use in a subterranean well is provided which includes at least one opening for fluid communication between an exterior of the valve and an interior longitudinal flow passage extending through the valve. A closure device selectively permits and prevents flow through the opening. A piston biases the closure device to displace, and the closure device is mechanically displaceable relative to the piston.

These and other features, advantages, benefits and objects will become apparent to one of ordinary skill in the art upon careful consideration of the detailed description of representative embodiments below and the accompanying drawings, in which similar elements are indicated in the various figures using the same reference numbers.

DETAILED DESCRIPTION

It is to be understood that the various embodiments described herein may be utilized in various orientations, such as inclined, inverted, horizontal, vertical, etc., and in various configurations, without departing from the principles of the present disclosure. The embodiments are described merely as examples of useful applications of the principles of this disclosure, which is not limited to any specific details of these embodiments.

In the following description of the representative embodiments, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
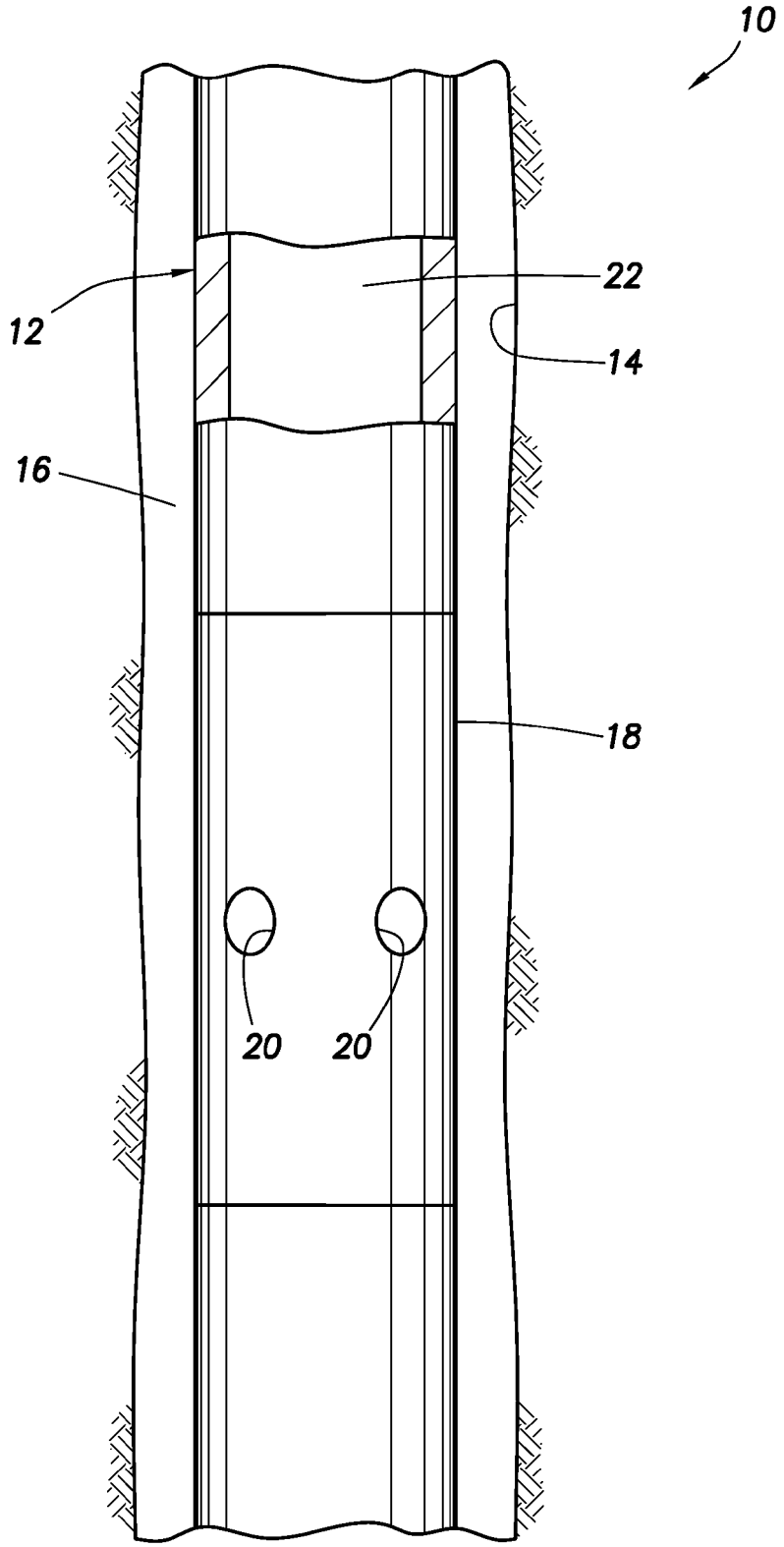
FIG. 1 is a schematic partially cross-sectional view of a well system and associated method embodying principles of the present disclosure.

Representatively illustrated in FIG. 1 is a well system and associated method 10 which embody principles of the present disclosure. In the well system 10, a tubular string 12 is installed in a wellbore 14, thereby forming an annulus 16 exterior to the tubular string. The wellbore 14 could be lined with casing or liner, in which case the annulus 16 may be formed between the tubular string 12 and the casing or liner.

The tubular string 12 could be a production tubing string which is cemented in the wellbore 14 to form what is known to those skilled in the art as a "cemented completion." This term describes a well completion in which production tubing is cemented in an otherwise uncased wellbore. However, it should be clearly understood that the present disclosure is not limited in any way to use in cemented completions, or to any other details of the well system 10 or method described herein.

If the tubular string 12 is cemented in the wellbore 14, it may be desirable to circulate cement out of an upper portion of the annulus 16. For this purpose, a circulation control valve 18 is provided in the well system 10.

Near the conclusion of the cementing operation, openings 20 in the valve 18 are opened to permit circulation flow between the annulus 16 and an interior flow passage 22 of the tubular string 12. After circulation flow is no longer desired, the openings 20 in the valve 18 are closed.

Referring additionally now to FIGS. 2A-D, the valve 18 is representatively illustrated at an enlarged scale and in greater detail. The valve 18 may be used in the well system 10 and associated method as described above, but the valve may alternatively be used in other systems and methods in keeping with the principles of this disclosure.

As depicted in FIGS. 2A-D, the valve 18 is in a run-in closed configuration in which flow through the openings 20 between the flow passage 22 and the annulus 16 is prevented. When used in a cemented completion, this configuration of the valve 18 would be used when the tubular string 12 is installed in the wellbore 14, and when cement is flowed into the annulus 16. When used in a staged cementing operation, the valve 18 may be open when cement is flowed into the annulus 16.

A generally tubular closure device 24 in the form of a sleeve is reciprocably displaceable within an outer housing assembly 26 of the valve 18 in order to selectively permit and prevent fluid flow through the openings 20. The closure device 24 carries flexible or resilient seals 28 thereon for sealing across the openings 20, but in an important feature of the embodiment of FIGS. 2A-D, a metal-to-metal seal 30 is also provided to ensure against leakage in the event that the other seals 28 fail.

Furthermore, another internal sleeve 36 and additional seals 32 are provided, so that the openings 20 can be sealed off positively. The sleeve 36 can be displaced from within the flow passage 22, for example, using a conventional shifting tool engaged with an internal shifting profile 34 in the sleeve. The sleeve 36 is depicted in its closed position in FIGS. 5A-D.

The metal-to-metal seal 30 is enhanced by operation of a sealing device 40 which includes an arrangement of pistons 38, 42 and a biasing device 44. In an important feature of the sealing device 40, at least one of the pistons 38, 42 applies a biasing force to the metal-to-metal seal 30 whether pressure in the flow passage 22 is greater than pressure in the annulus 16, or pressure in the annulus is greater than pressure in the flow passage.

Figure 2A:
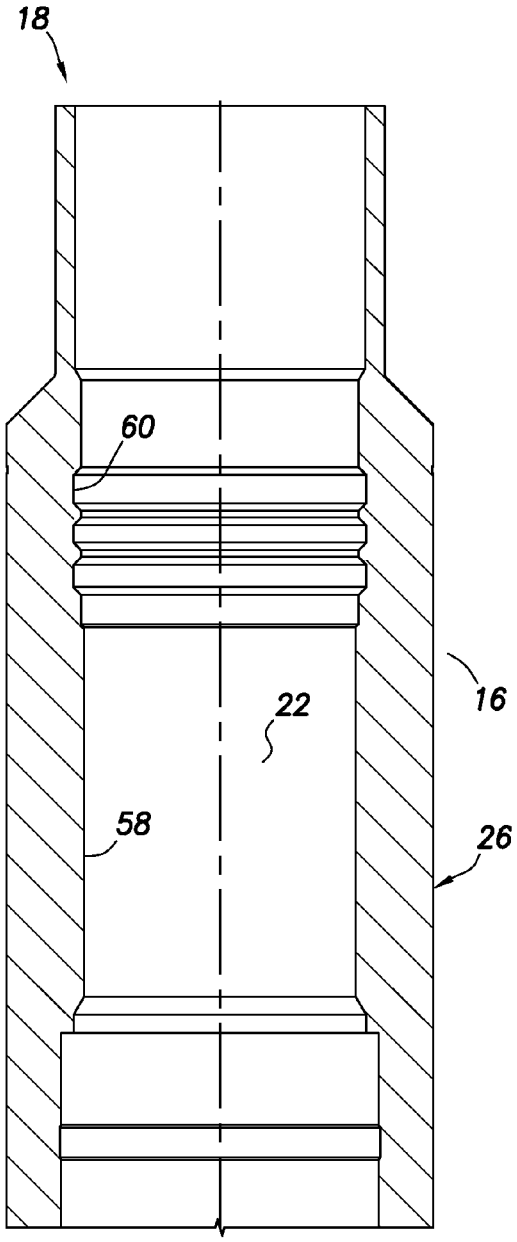
FIGS. 2A-D are enlarged scale cross-sectional views of successive axial sections of a circulation control valve which may be used in the well system and method of FIG. 1, the valve being depicted in a run-in closed configuration.
Figure 2B:
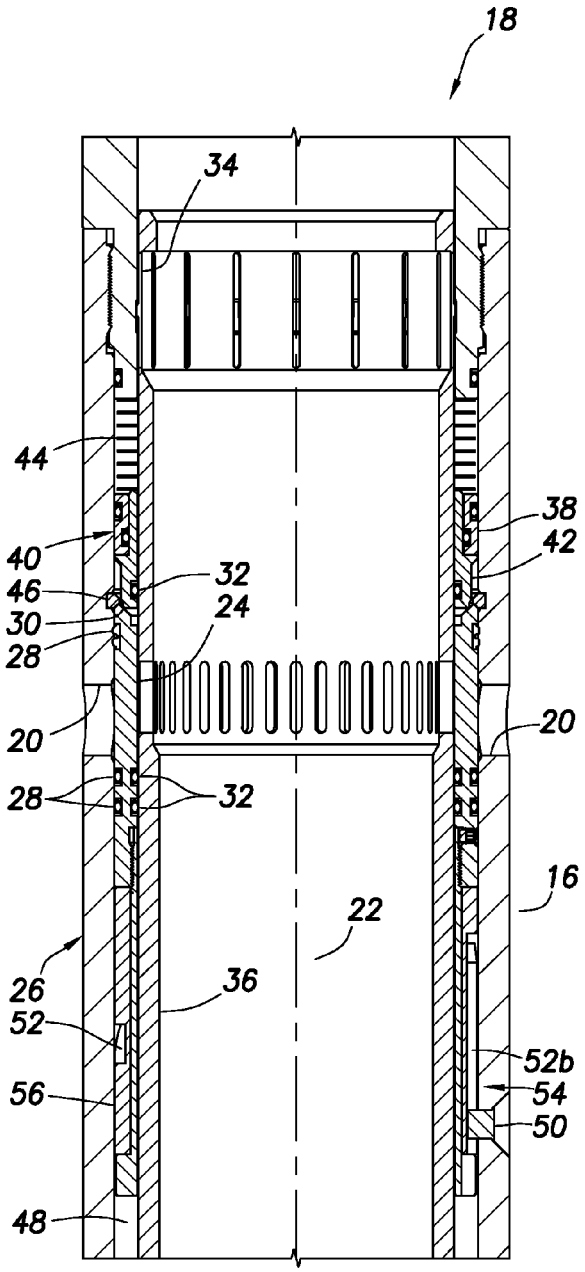
Figure 2C:
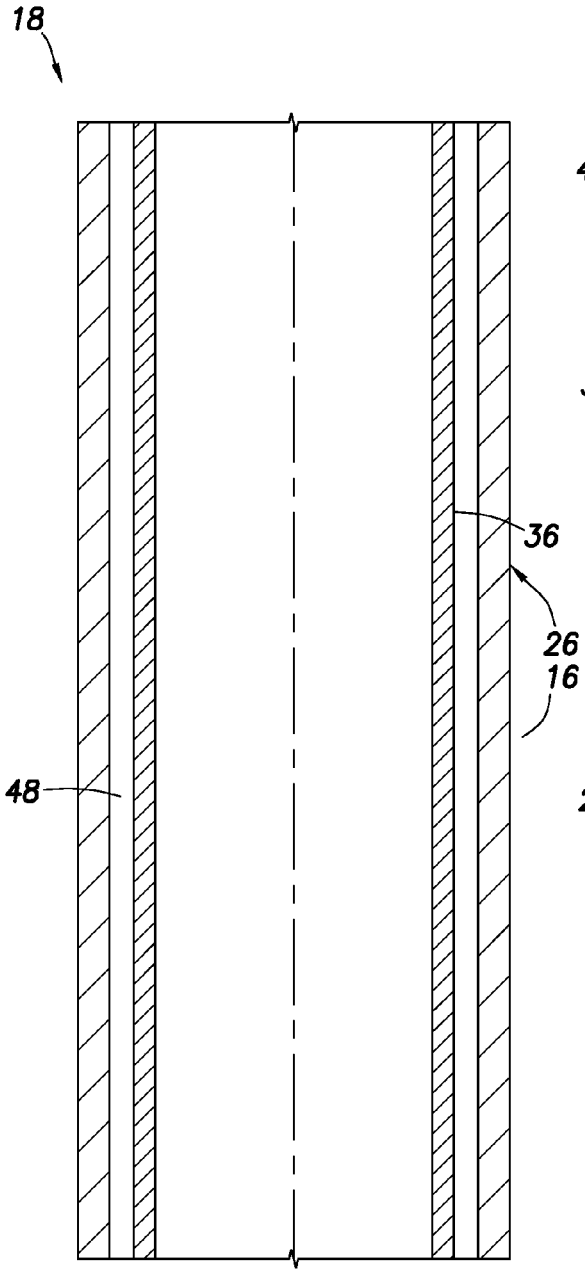
Figure 2D:
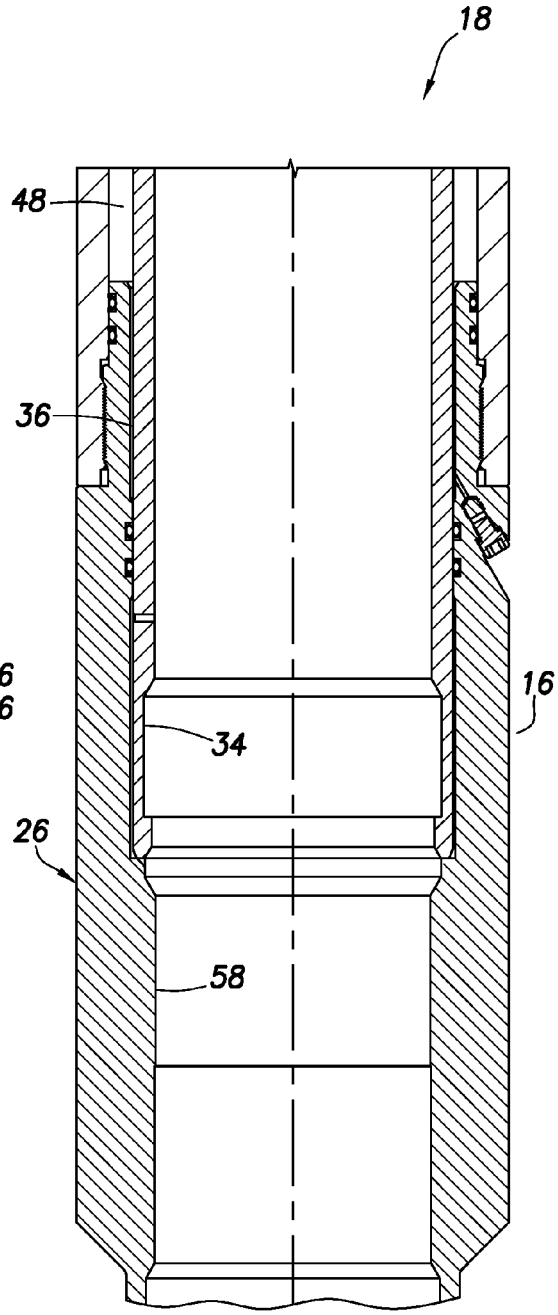
Figure 3A:
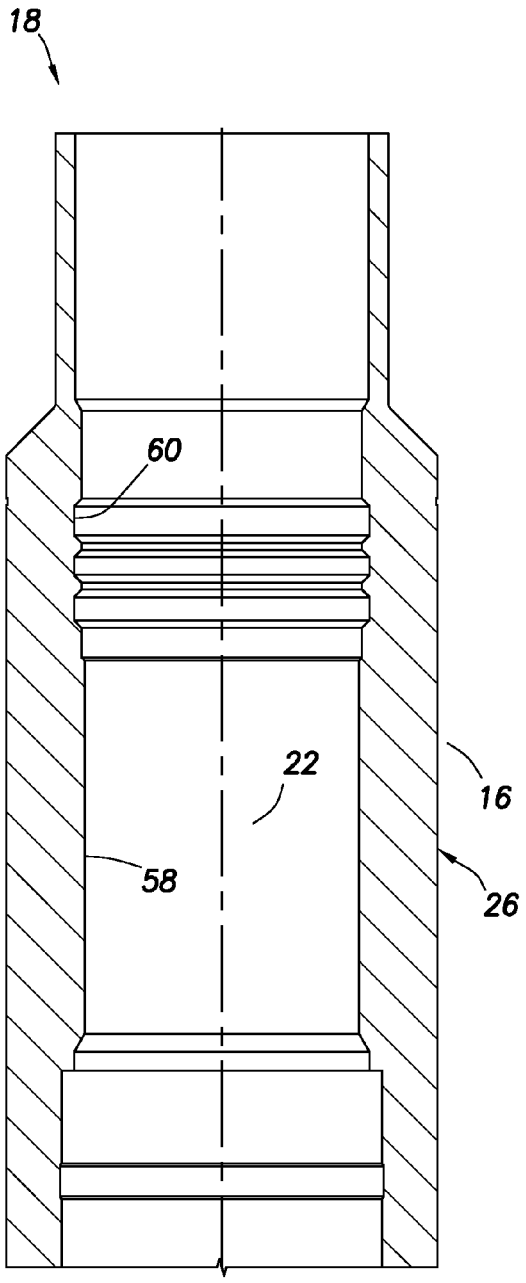
FIGS. 3A-D are cross-sectional views of successive axial sections of the valve of FIGS. 2A-D, the valve being depicted in an open circulating configuration.
Figure 3B:
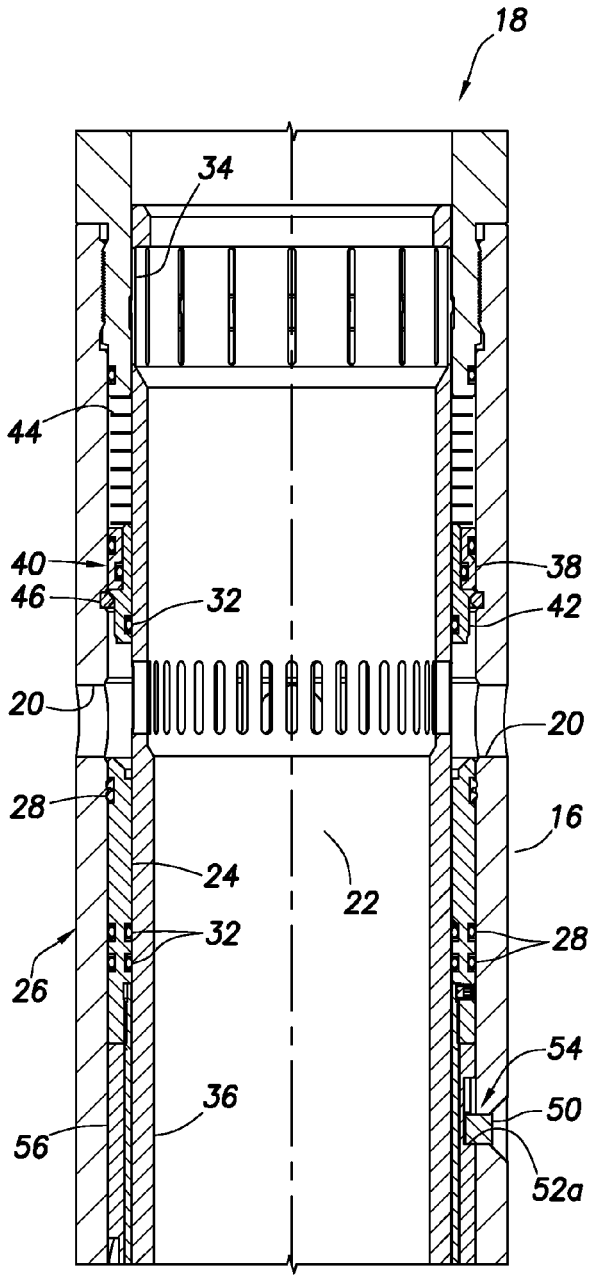
Figure 3C:
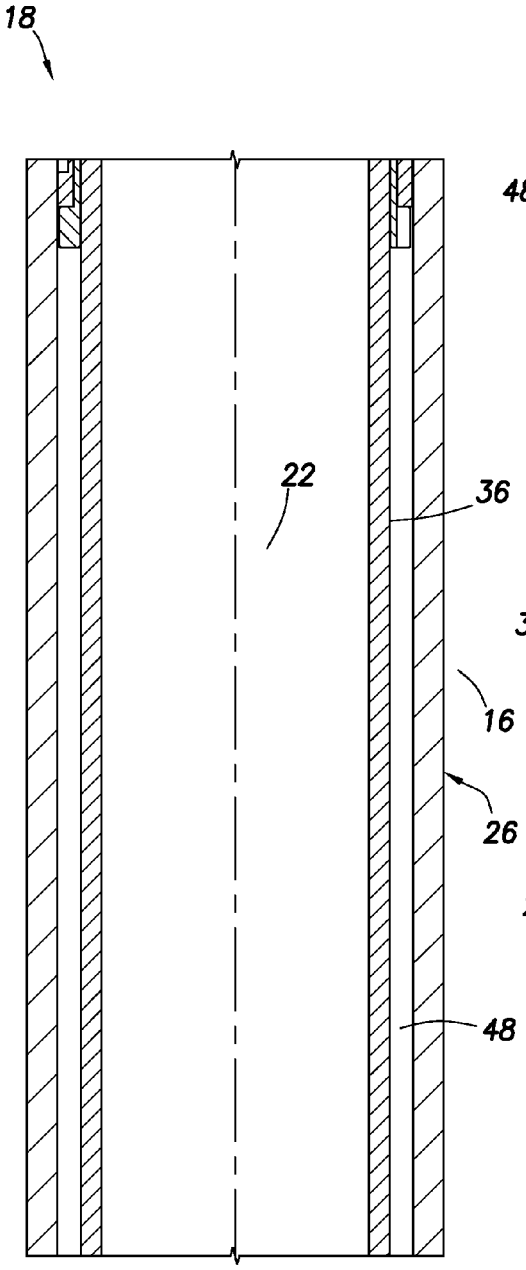
Figure 3D:
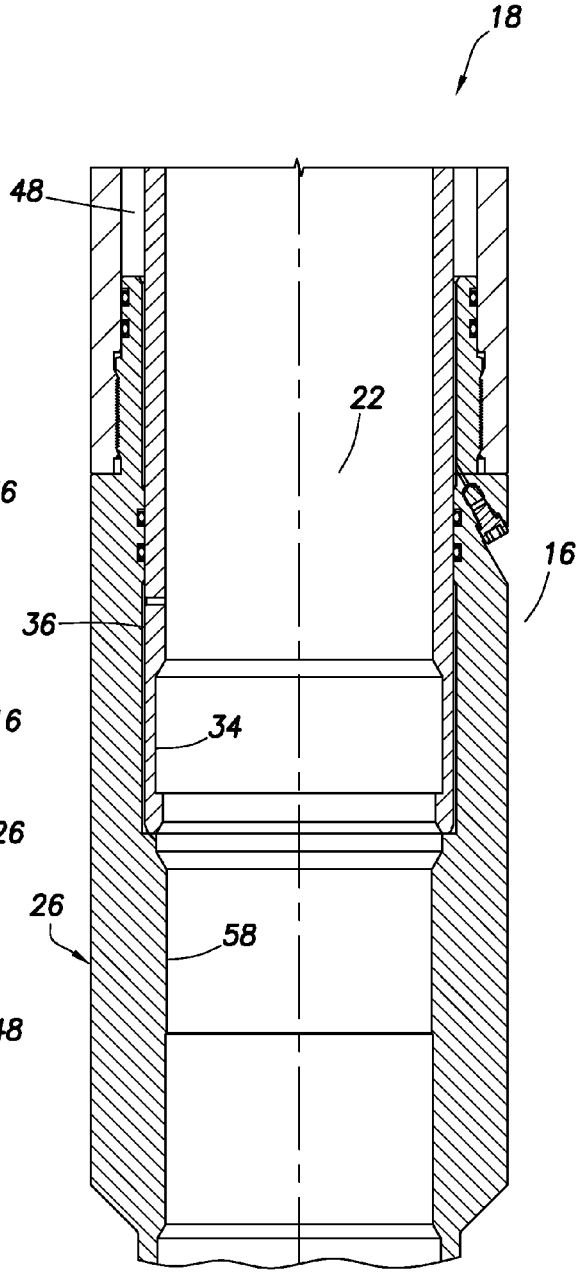

This feature of the sealing device 40 is due to a unique configuration of differential piston areas on the pistons 38, 42. As will be appreciated by those skilled in the art from a consideration of the arrangement of the pistons 38, 42 as depicted in FIG. 2B, when pressure in the flow passage 22 is greater than pressure in the annulus 16, the pistons will be biased downwardly as viewed in the drawing, thereby applying a downwardly biasing force to the metal-to-metal seal 30.

When pressure in the annulus 16 is greater than pressure in the flow passage 22, the piston 38 will be biased upwardly as viewed in the drawing, but the piston 42 will be biased downwardly, thereby again applying a downwardly biasing force to the metal-to-metal seal 30. Thus, no matter the direction of the pressure differential between the flow passage 22 and the annulus 16, the metal-to-metal seal 30 between the piston 42 and the closure device 24 is always enhanced by the sealing device 40.

The biasing device 44 is used to exert an initial biasing force to the metal-to-metal seal 30. A snap ring 46 installed in the housing assembly 26 limits upward displacement of the closure device 24 and limits downward displacement of the pistons 38, 40.

The closure device 24 is biased upwardly by means of a pressurized internal chamber 48. The chamber 48 could, for example, contain nitrogen or another inert gas at a pressure exceeding any hydrostatic pressure expected to be experienced at the valve 18 in the wellbore 14. Other compressible fluids, such as silicone, etc., could be used in the chamber 48, if desired.

The seals 28, 32 on the lower end of the closure device 24 close off an upper end of the chamber 48. The upper end of the closure device 24 is exposed to pressure in the flow passage 22. Thus, if pressure in the flow passage 22 is increased sufficiently, so that it is greater than the pressure in the chamber 48, the closure device 24 will be biased to displace downwardly.

Displacement of the closure device 24 relative to the housing assembly 26 is limited by means of a displacement limiting device 54. The device 54 includes one or more pin or lug(s) 50 secured to the housing assembly 26, and a sleeve 56 rotationally attached to the closure device 24, with the sleeve having one or more profile(s) 52 formed thereon for engagement by the lug.

Referring additionally now to FIGS. 3A-D, the valve 18 is representatively illustrated in a configuration in which pressure in the flow passage 22 has been increased to a level greater than the pressure in the chamber 48. As a result, the closure device 24 has displaced downwardly relative to the housing assembly 26, and fluid flow through the openings 20 is now permitted.

Subsequent release of the increased pressure in the flow passage 22 allows the lug 50 in the housing assembly 26 to engage a recessed portion 52*a* of the profile 52. This functions to secure the closure device 24 in its open position, without the need to maintain the increased pressure in the flow passage 22.

Figure 6:
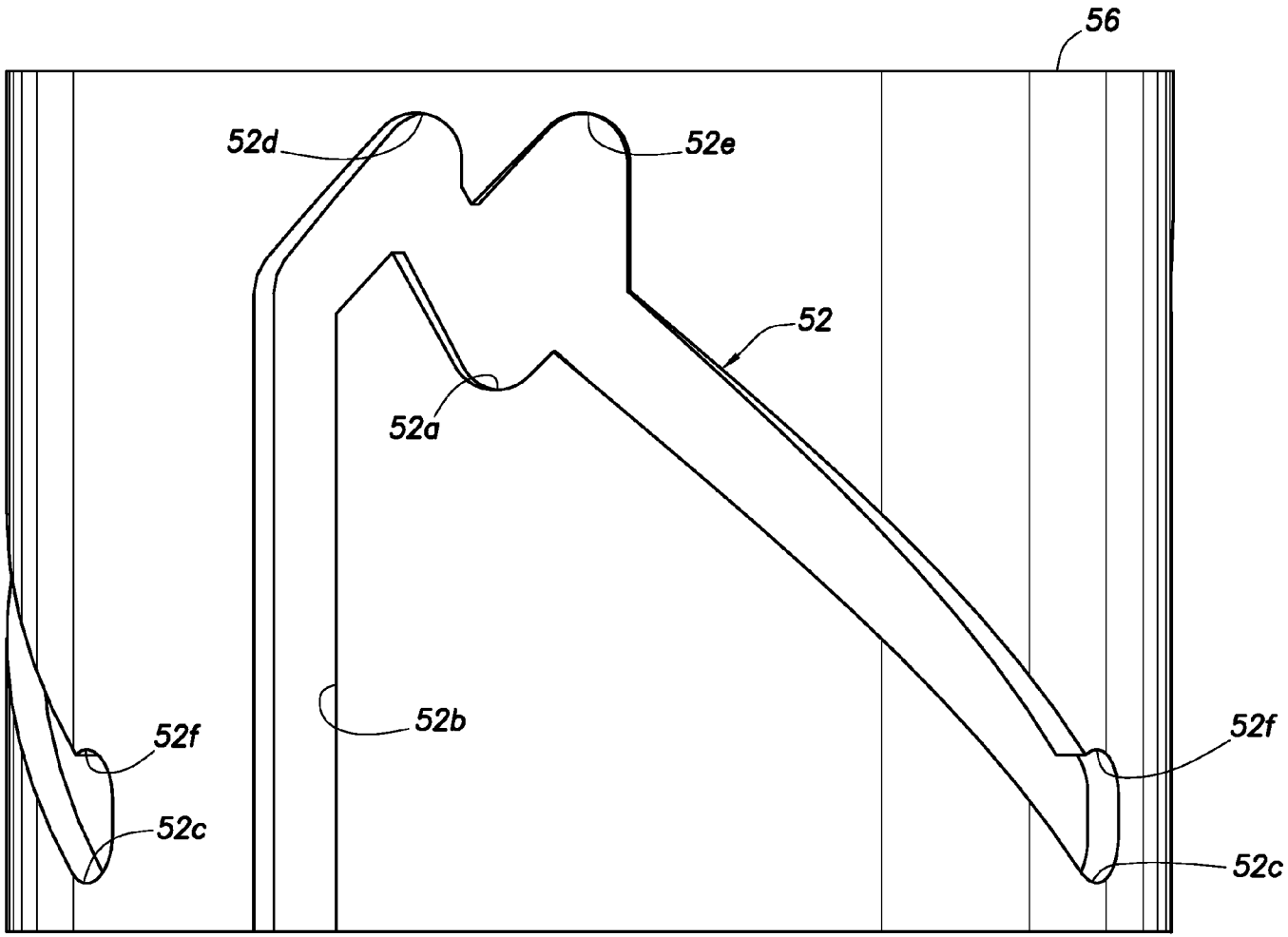
FIG. 6 is a further enlarged scale elevational view of a displacement limiting device of the valve of FIGS. 2A-D.
Figure 7A:
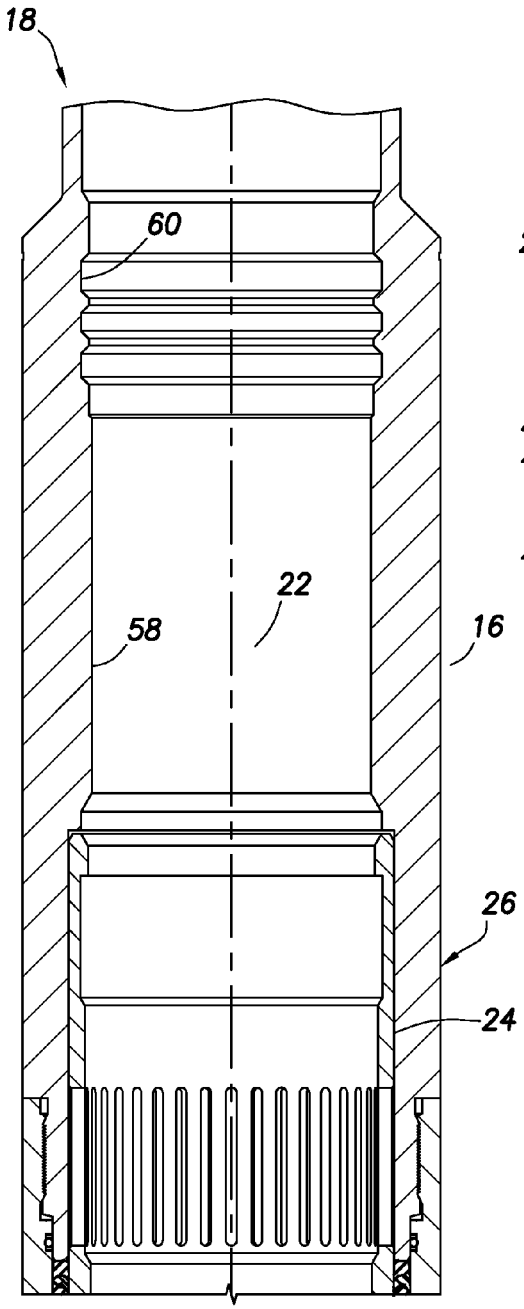
FIGS. 7A-D are cross-sectional views of successive axial sections of another construction of the circulation control valve which may be used in the well system and method of FIG. 1, the valve being depicted in a run-in closed configuration.
Figure 7B:
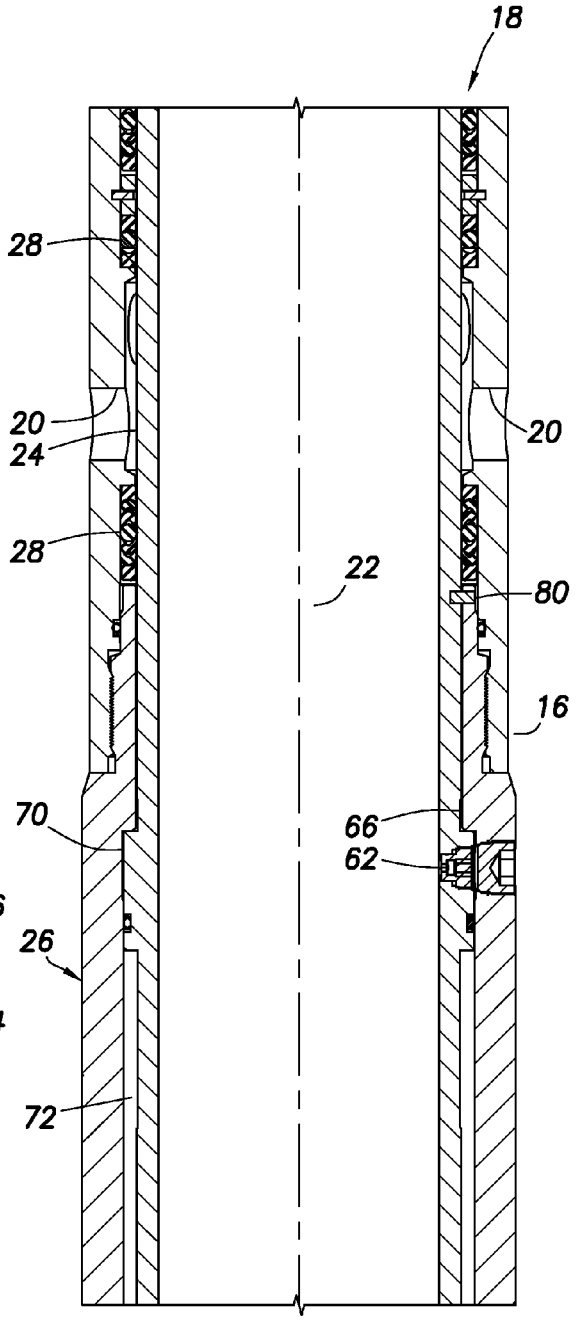
Figure 7C:
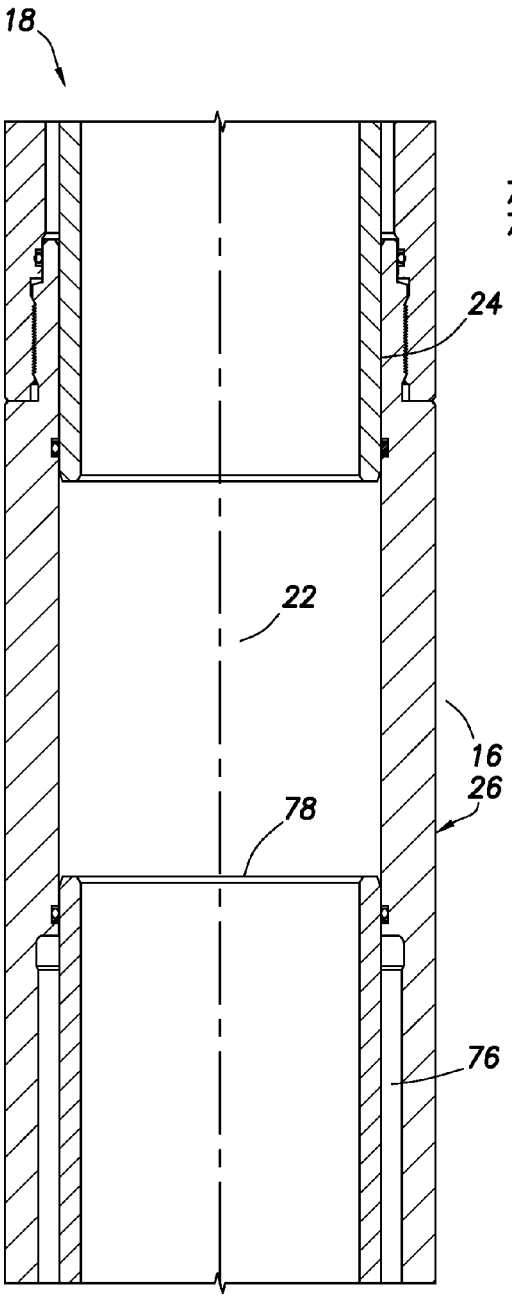
Figure 7D:
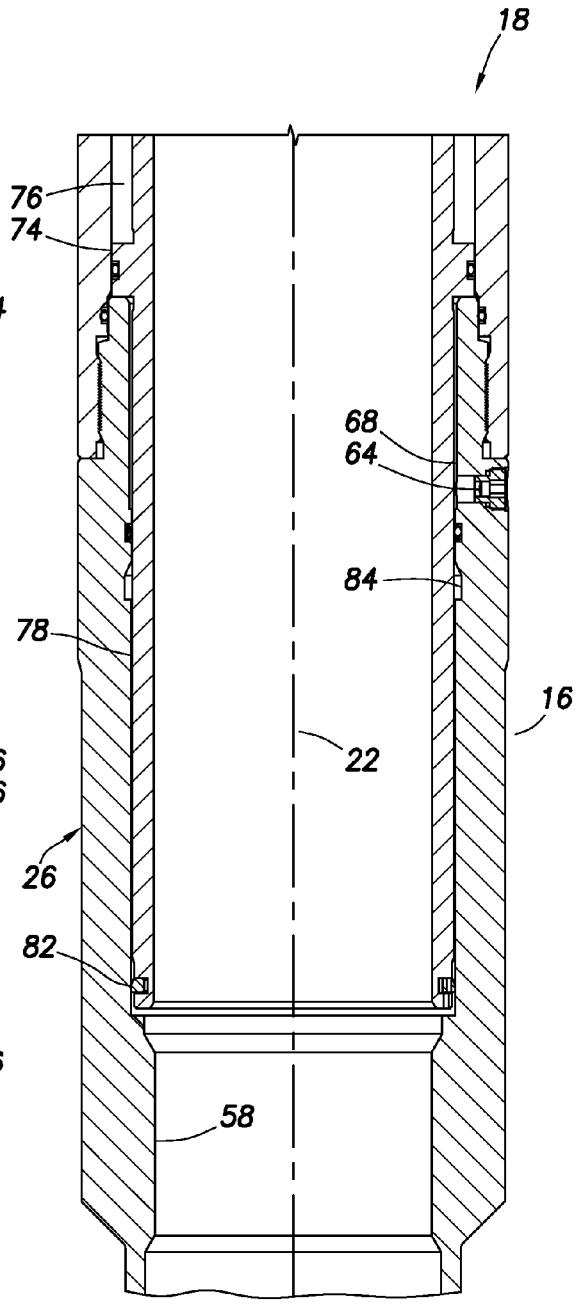
Figure 8A:
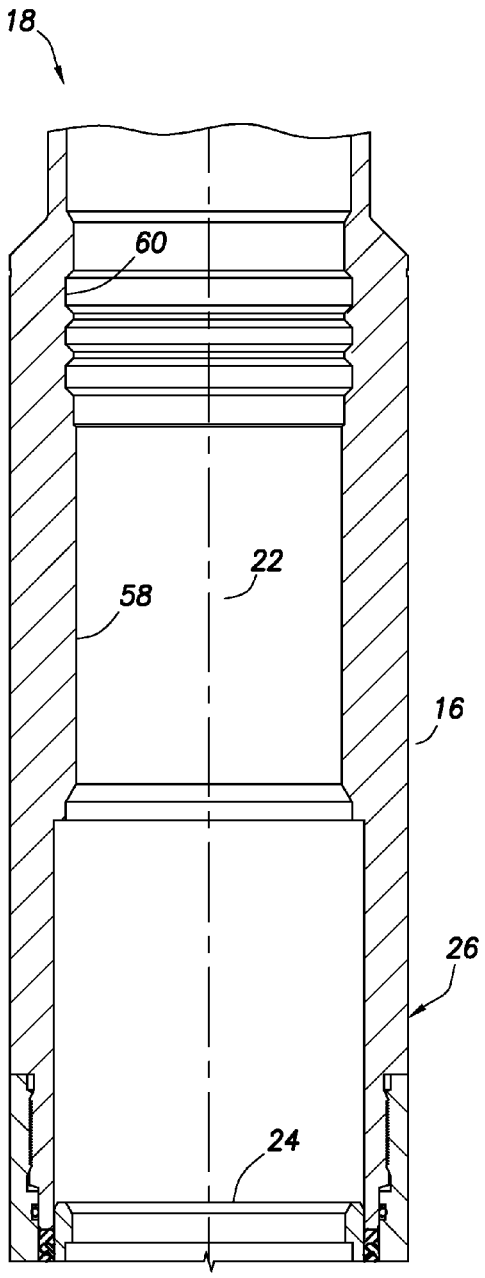
FIGS. 8A-D are cross-sectional views of successive axial sections of the valve of FIGS. 7A-D, the valve being depicted in an open circulating configuration.
Figure 8B:
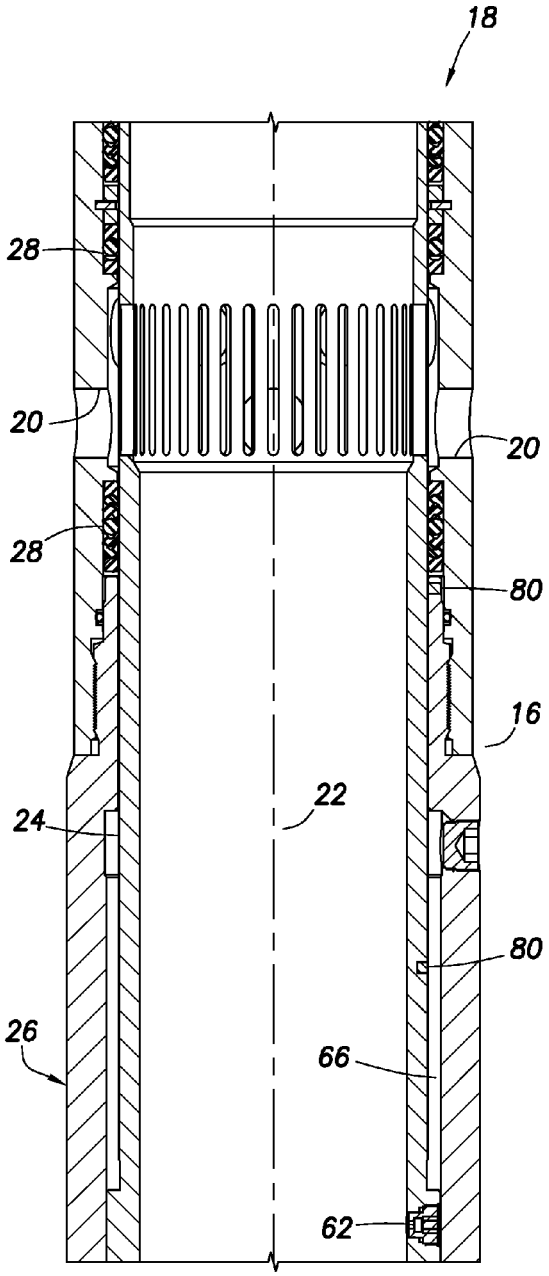
Figure 8C:
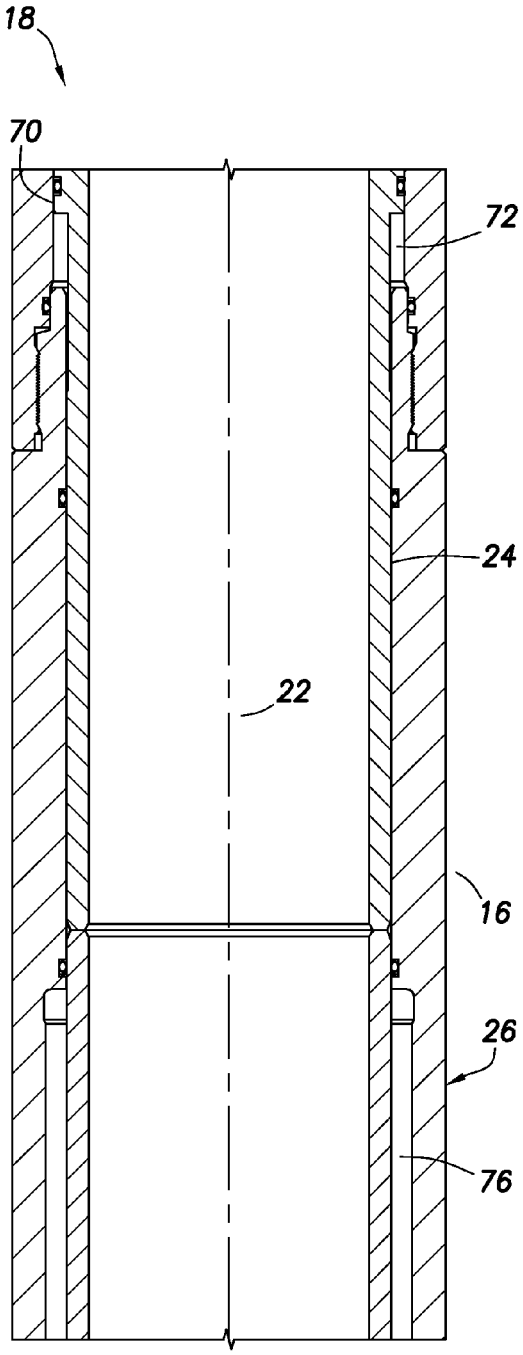
Figure 8D:
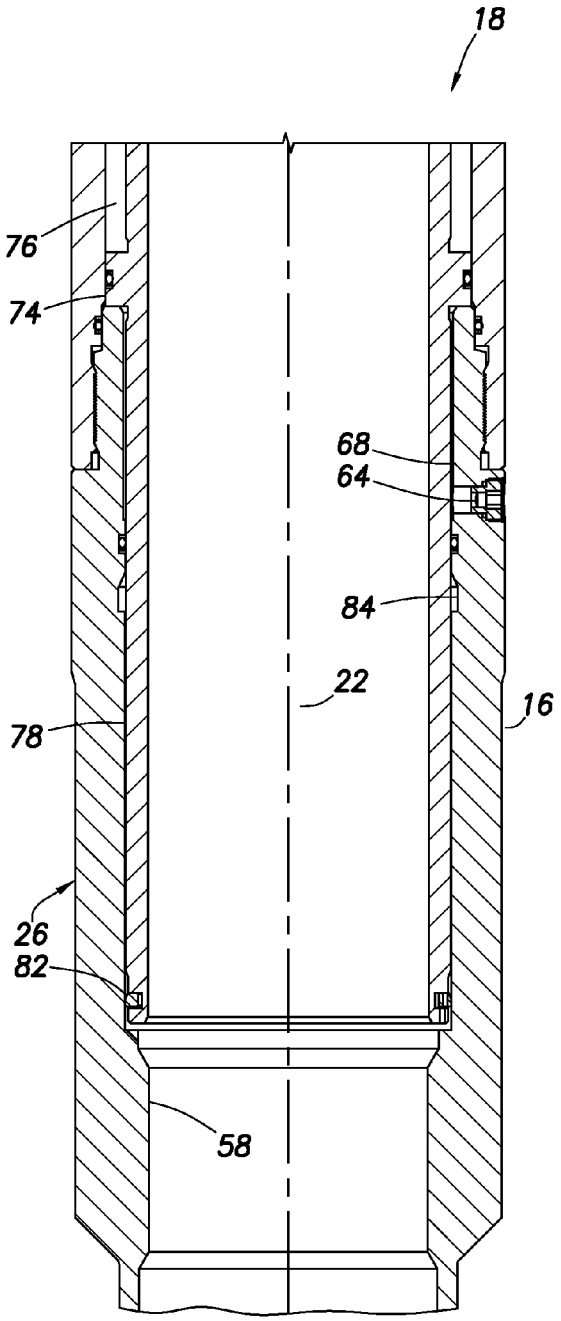
Figure 9A:
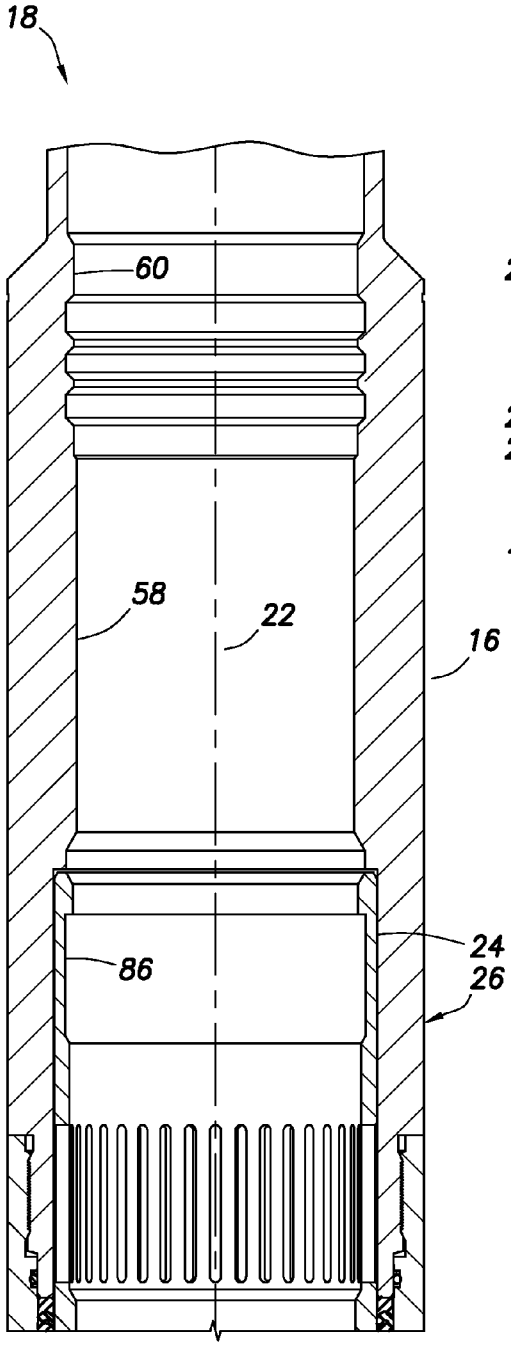
FIGS. 9A-D are cross-sectional views of successive axial sections of the valve of FIGS. 7A-D, the valve being depicted in a subsequent closed configuration.
Figure 9B:
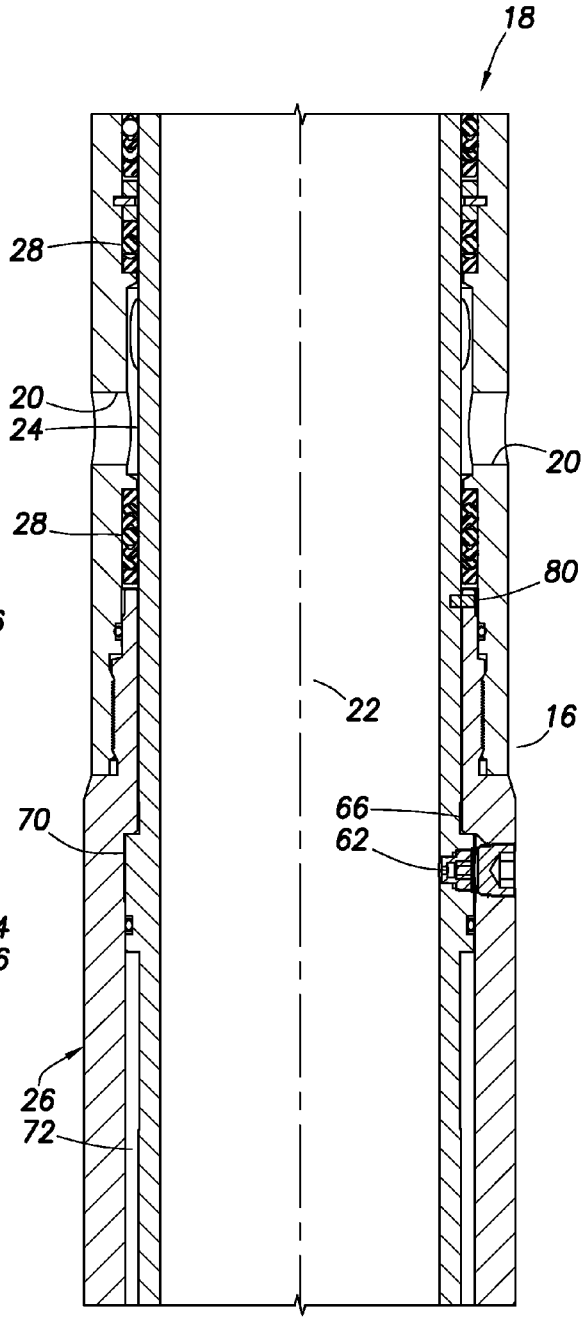
Figure 9C:
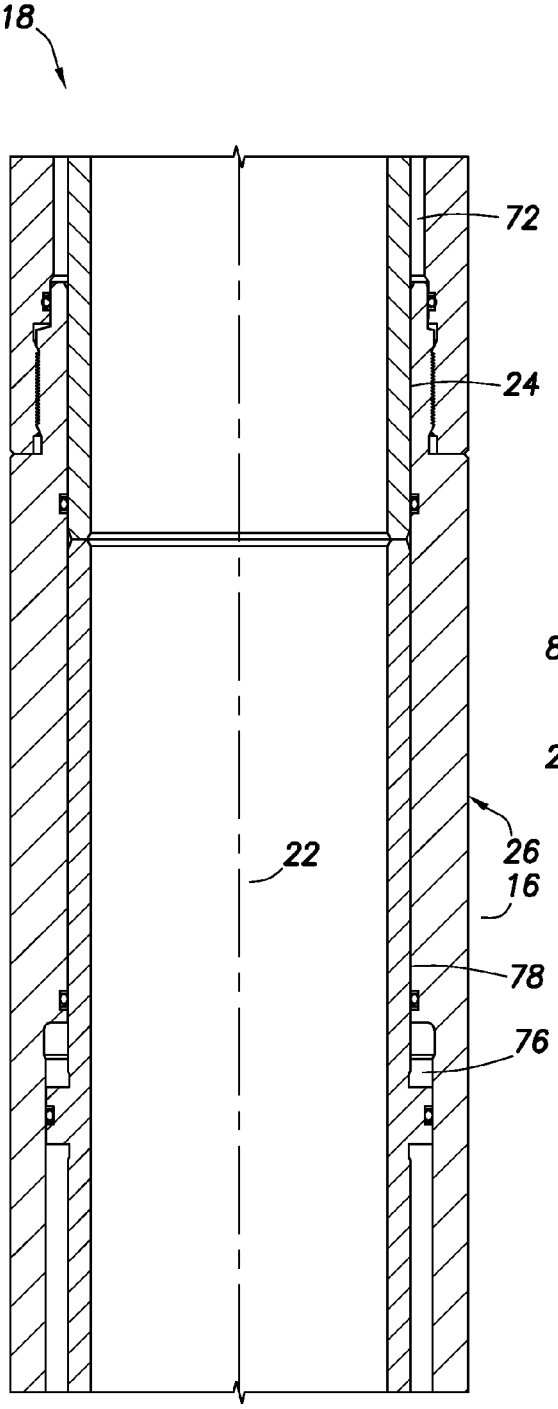
Figure 9D:
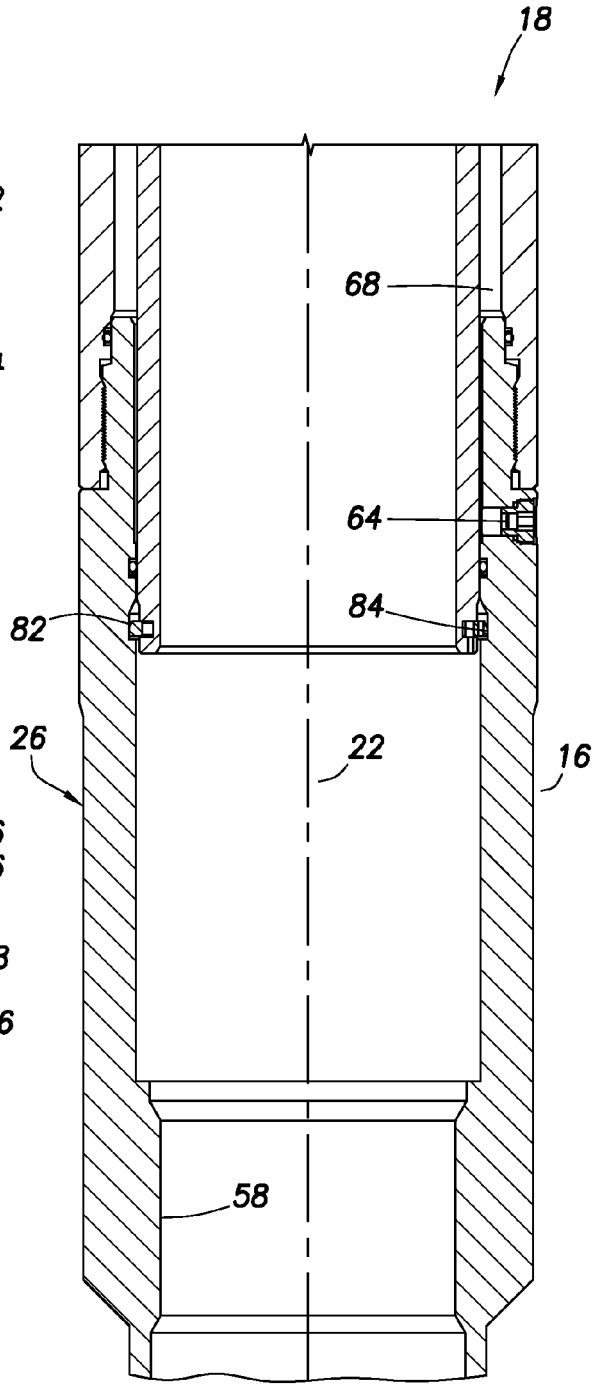

An enlarged scale view of the sleeve 56 and profile 52 thereon is representatively illustrated in FIG. 6. In this view it may be seen that the lug 50 can displace relative to the profile 52 between several portions 52*a-f* of the profile.

Initially, in the run-in configuration of FIGS. 2A-D, the lug 50 is engaged in a generally straight longitudinally extending profile portion 52*b*. When pressure in the flow passage 22 has been increased so that it is greater than pressure in the chamber 48, the lug 50 will be engaged in profile portion 52*d* (with the valve 18 being open). Subsequent release of the increased pressure in the flow passage 22 will cause the lug 50 to engage profile portion 52*a*, thereby maintaining the valve 18 in its open configuration.

Another application of increased pressure to the flow passage 22 greater than pressure in the chamber 48 will cause the lug 50 to engage profile portion 52*e* (with the valve 18 still being open). Subsequent release of the increased pressure in the flow passage 22 will cause the lug 50 to engage profile portion 52*c*, with the closure device 24 correspondingly displacing to its closed position (as depicted in FIGS. 4A-D).

Further increases and decreases in pressure in the flow passage 22 will not result in further opening and closing of the valve 18. Instead, the lug 50 will move back and forth between profile portions 52*c* & *f*. This is beneficial in cemented completions, in which further circulation through the valve 18 is not desired. However, further openings and closings of the valve 18 could be provided, for example, by making the profile 52 continuous about the sleeve 56 in the manner of a conventional continuous J-slot, if desired.

Referring additionally now to FIGS. 4A-D, the valve 18 is representatively illustrated after the second application of increased pressure to the flow passage 22, and then release of the increased pressure as described above. The valve 18 is now in a closed configuration, in which fluid communication between the flow passage 22 and annulus 16 via the openings 20 is prevented by the closure device 24.

Figure 4A:
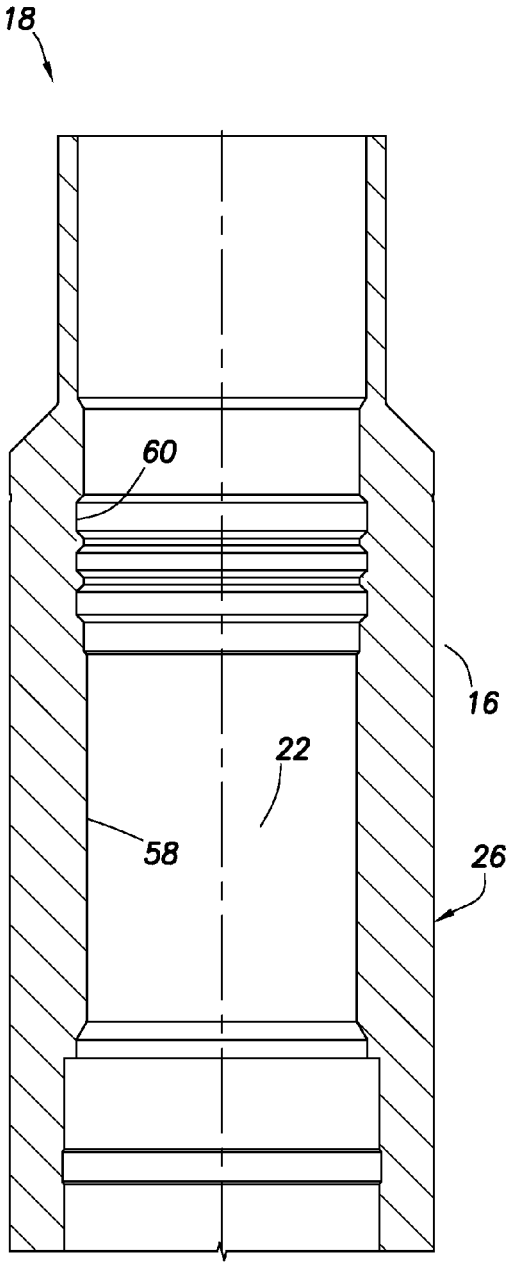
FIGS. 4A-D are cross-sectional views of successive axial sections of the valve of FIGS. 2A-D, the valve being depicted in a subsequent closed configuration.
Figure 4B:
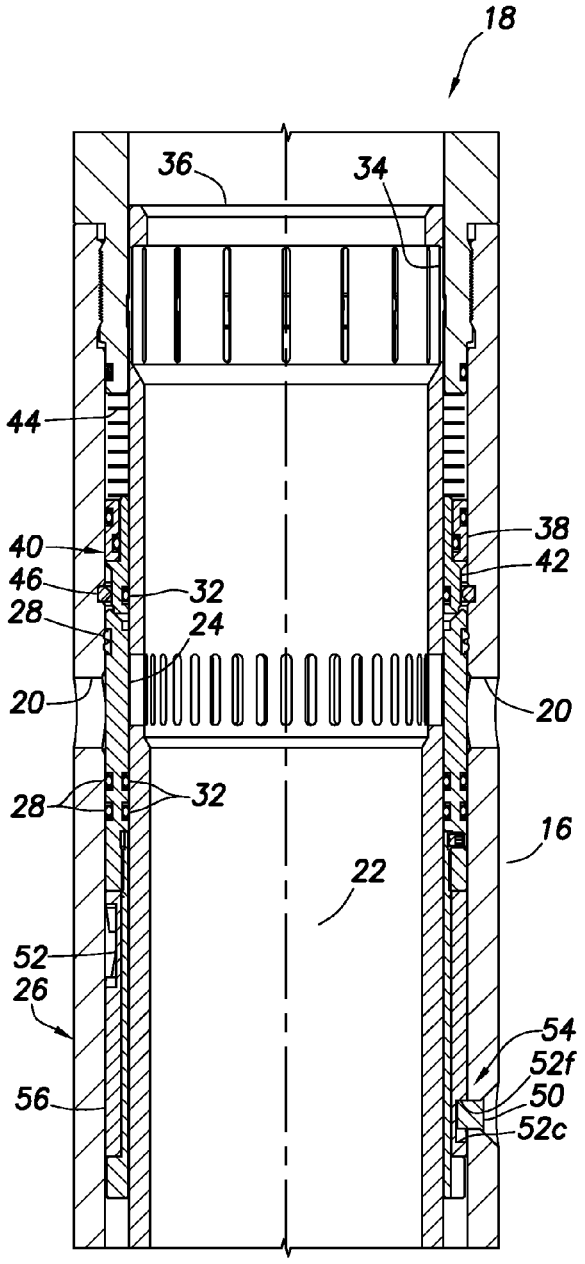
Figure 4C:
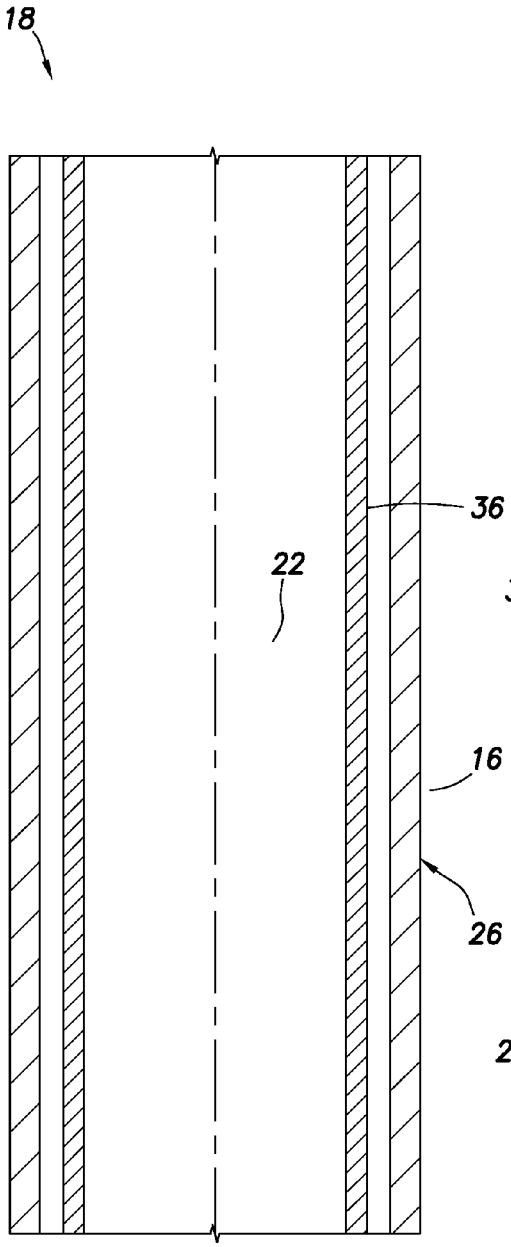
Figure 4D:
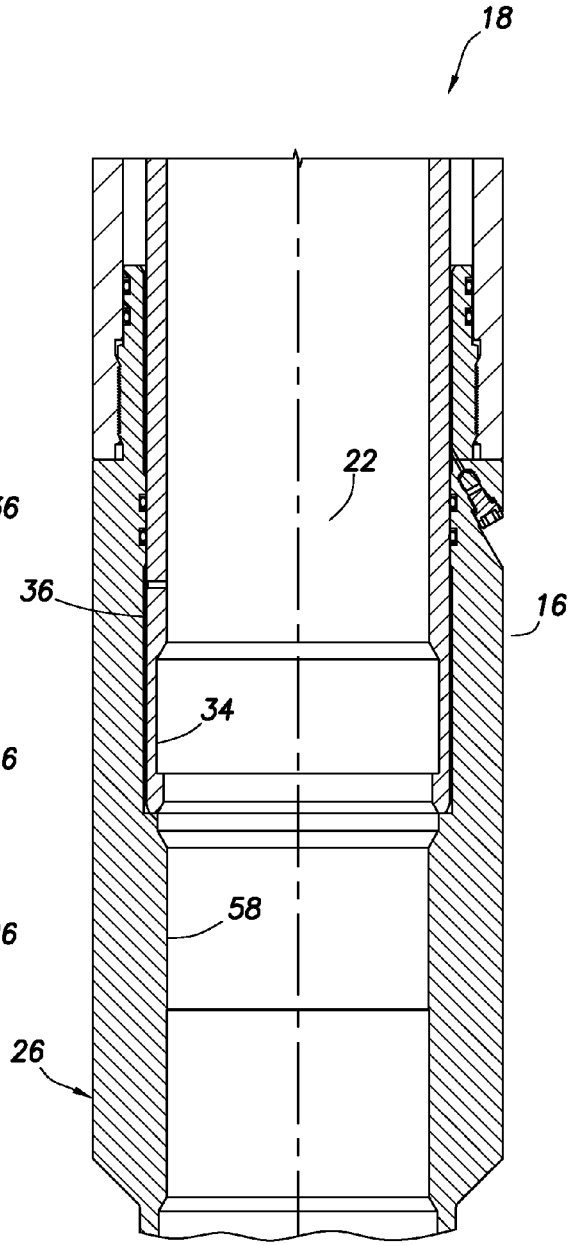
Figure 5A:
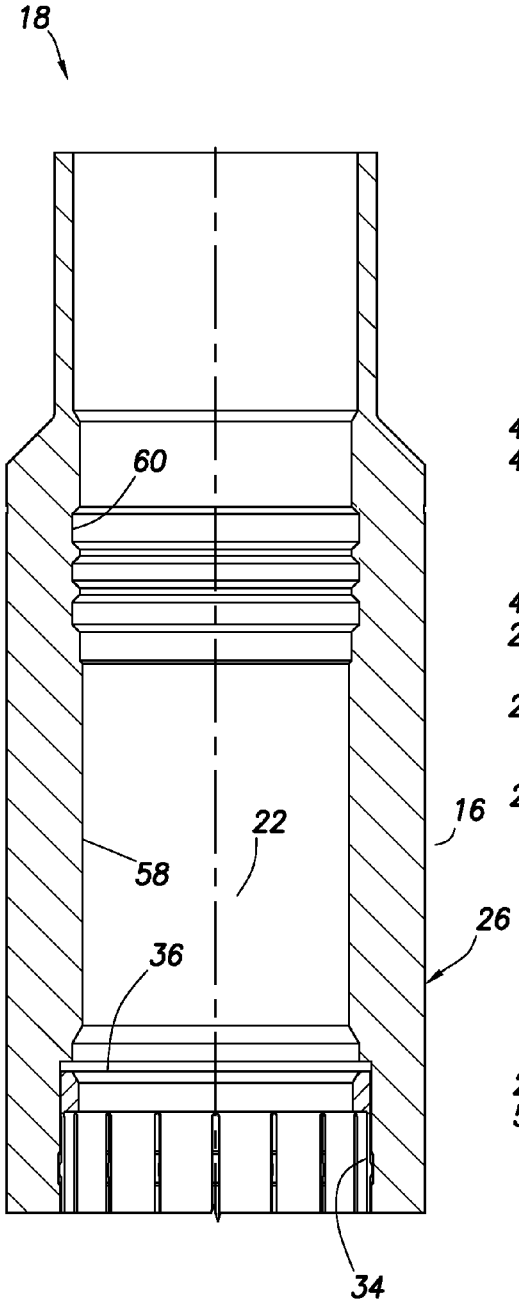
FIGS. 5A-D are cross-sectional views of successive axial sections of the valve of FIGS. 2A-D, the valve being depicted in another closed configuration.
Figure 5B:
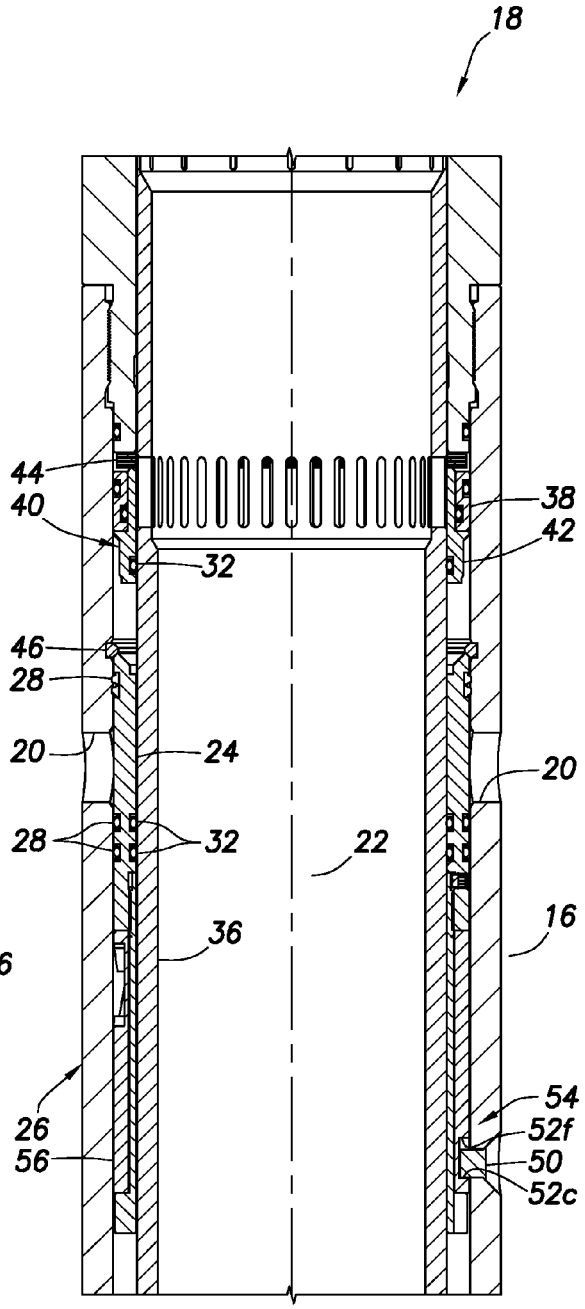
Figure 5C:
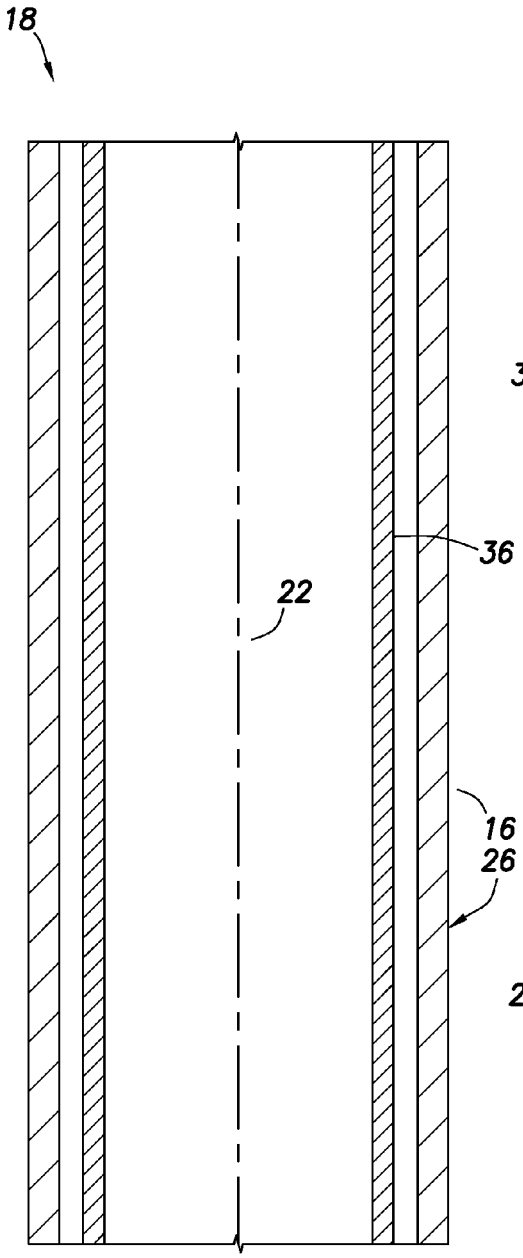
Figure 5D:
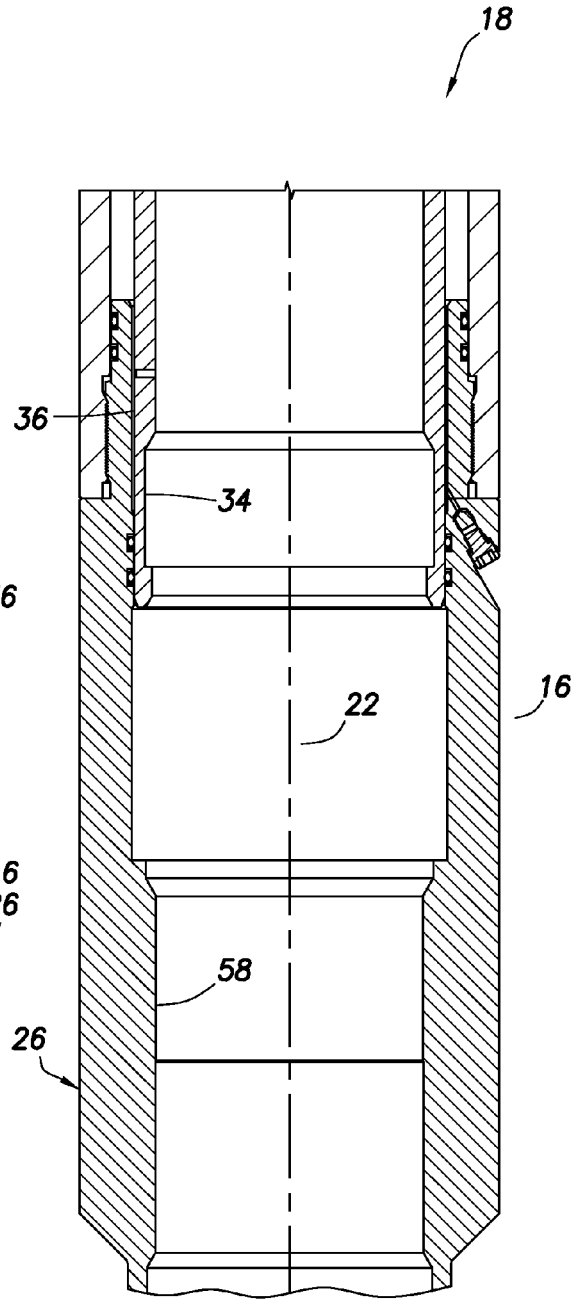

Note that the lug 50 is now engaged with the profile portion 52*f* as depicted in FIG. 4B. This demonstrates that further increases in pressure in the flow passage 22 do not cause the valve 18 to open, since the device 54 limits further downward displacement of the closure device 24.

However, it will be readily appreciated that the profile 52 could be otherwise configured, for example, as a continuous J-slot type profile, to allow multiple openings and closings of the valve 18. Thus, the closure device 24 can be repeatedly displaced upward and downward to close and open the valve 18 in response to multiple applications and releases of pressure in the flow passage 22, if the profile 52 is appropriately configured.

Referring additionally now to FIGS. 5A-D, the valve 18 is representatively illustrated in a closed configuration in which the internal sleeve 36 has been displaced upwardly, so that it now blocks flow through the openings 20 between the annulus 16 and flow passage 22. Displacement of the sleeve 36 may be accomplished by any of a variety of means, but preferably a conventional wireline or tubing conveyed shifting tool is used.

The sleeve 36 may be displaced as a contingency operation, in the event that one or more of the seals 28, 32 leak, or the closure device 24 is otherwise not operable to prevent fluid communication between the flow passage 22 and the annulus 16 via the openings 20. Seal bores 58 and a latching profile 60 may also (or alternatively) be provided for installation of a conventional packoff sleeve, if desired.

Referring additionally now to FIGS. 7A-D, an alternate configuration of the circulation control valve 18 is representatively illustrated. The configuration of FIGS. 7A-D is similar in many respects to the configuration described above, most notably in that both configurations open in response to application of a pressure increase to the flow passage 22, and then close following application of a subsequent pressure increase to the flow passage.

However, the configuration of FIGS. 7A-D utilizes valve devices 62, 64 to control displacement of the closure device 24. The valve devices 62, 64 could be, for example, conventional rupture disks, shear pinned shuttle valves or any other type of valve devices which open in response to application of a certain pressure differential. The valve devices 62, 64 are selected to isolate respective internal chambers 66, 68 from well pressure until corresponding predetermined differential pressures are applied across the valve devices, at which point the devices open and permit fluid communication therethrough.

A radially enlarged piston 70 on the closure device 24 is exposed to the chamber 66 on its upper side, and a lower side of the piston is exposed to another chamber 72. Another radially enlarged piston 74 on a sleeve 78 positioned below the closure device 24 is exposed to the chamber 68 on its lower side, and an upper side of the piston is exposed to another chamber 76.

All of the chambers 66, 68, 72, 76 initially preferably contain a compressible fluid (such as air) at a relatively low pressure (such as atmospheric pressure). However, other fluids (such as inert gases, silicone fluid, etc.) and other pressures may be used, if desired.

The closure device 24 is initially maintained in its closed position by one or more shear pins 80. However, when pressure in the flow passage 22 is increased to achieve a predetermined pressure differential (from the flow passage to the chamber 66), the valve device 62 will open and admit the well pressure into the chamber 66. The resulting pressure differential across the piston 70 (between the chambers 66, 72) will cause a downwardly directed biasing force to be exerted on the closure device 24, thereby shearing the shear pins 80 and downwardly displacing the closure device.

Referring additionally now to FIGS. 8A-D, the valve 18 is representatively illustrated after the closure device 24 has displaced downwardly following opening of the valve device 62. Fluid communication between the flow passage 22 and the annulus 16 via the openings 20 is now permitted.

When it is desired to close the valve 18, pressure in the flow passage 22 and annulus 16 may be increased to a predetermined pressure differential (from the annulus to the chamber 68) to open the valve device 64. Note that the valve device 64 is physically exposed to the annulus 16, rather than to the flow passage 22, and so the valve device is not in fluid communication with the flow passage until the closure device 24 is displaced downwardly to open the valve 18. As a result, it is not necessary for the predetermined pressure differential used for opening the valve device 64 to be greater than the predetermined pressure differential used for opening the valve device 62.

When the valve device 64 opens, well pressure will be admitted into the chamber 68, and the resulting pressure differential (between the chambers 68, 76) across the piston 74 will cause an upwardly directed biasing force to be exerted on the sleeve 78. The sleeve 78 will displace upwardly and contact the closure device 24. Since the piston 74 has a greater differential piston area than that of the piston 70, the upwardly directed biasing force due to the pressure differential across the piston 74 will exceed the downwardly directed biasing force due to the pressure differential across the piston 70, and the closure device 24 will displace upwardly as a result.

Referring additionally now to FIGS. 9A-D, the valve 18 is representatively illustrated after the closure device 24 has displaced upwardly following opening of the valve device 64. The closure device 24 again prevents fluid communication between the flow passage 22 and the annulus 16 via the openings 20.

A snap ring 82 carried on the sleeve 78 now engages an internal profile 84 formed in the housing assembly 26 to prevent subsequent downward displacement of the closure device 24. Note that an internal sleeve 36 and/or latching profile 60 and seal bores 58 may be provided for ensuring that the openings 20 can be sealed off as a contingency measure, or as a matter of course when operation of the valve 18 is no longer needed.

However, in the alternate configuration of FIGS. 7A-9D, the closure device 24 is itself provided with a shifting profile 86 to allow the closure device to be displaced to its closed position from the interior of the flow passage 22 (such as, using a conventional shifting tool), in the event that the closure device cannot be otherwise displaced upwardly (such as, due to seal leakage or valve device malfunction, etc.).

Figure 10A:
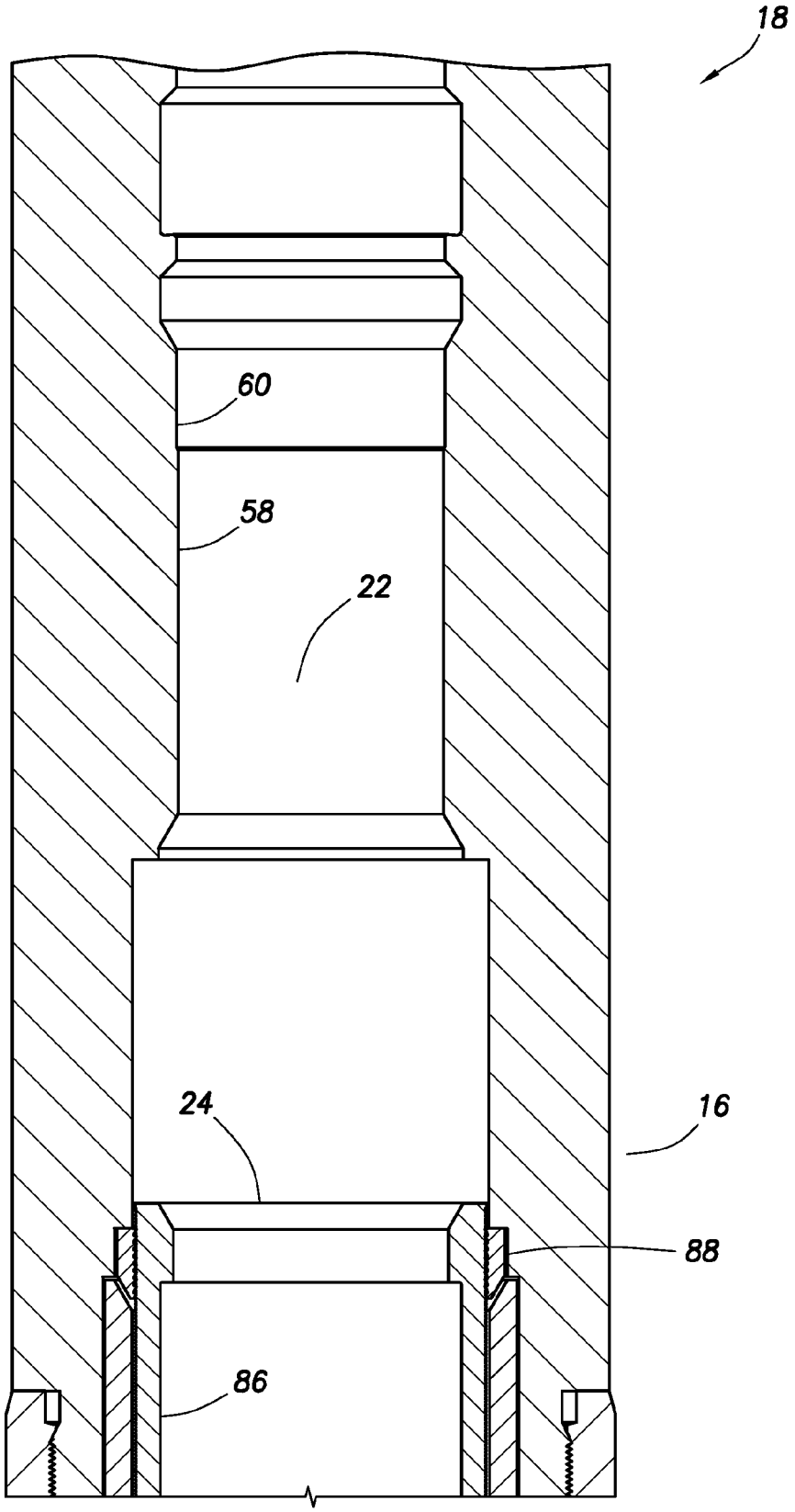
FIGS. 10A-C are cross-sectional views of successive axial sections of another construction of the circulation control valve which may be used in the well system and method of FIG. 1, the valve being depicted in a run-in closed configuration.
Figure 10B:
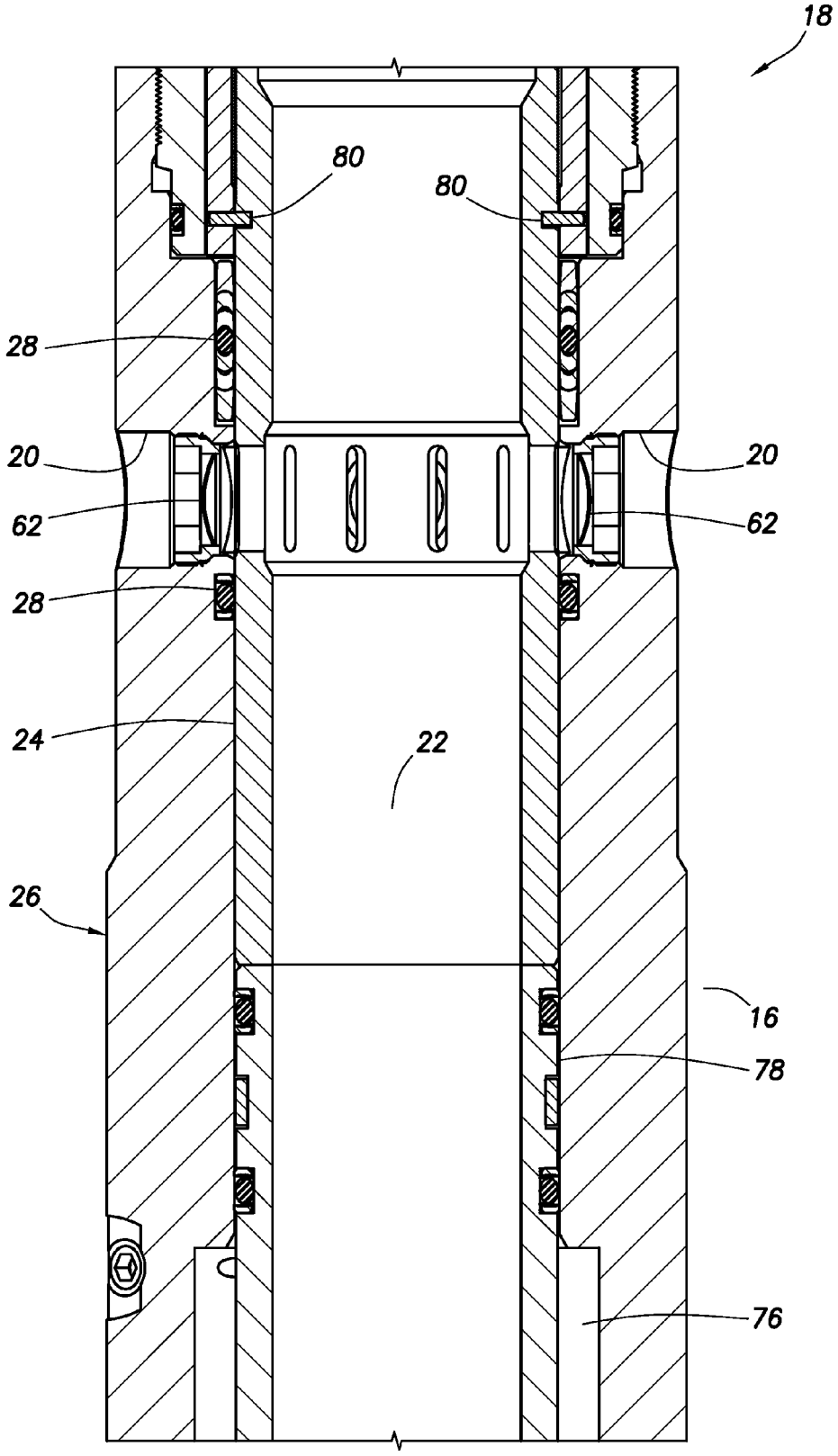
Figure 10C:
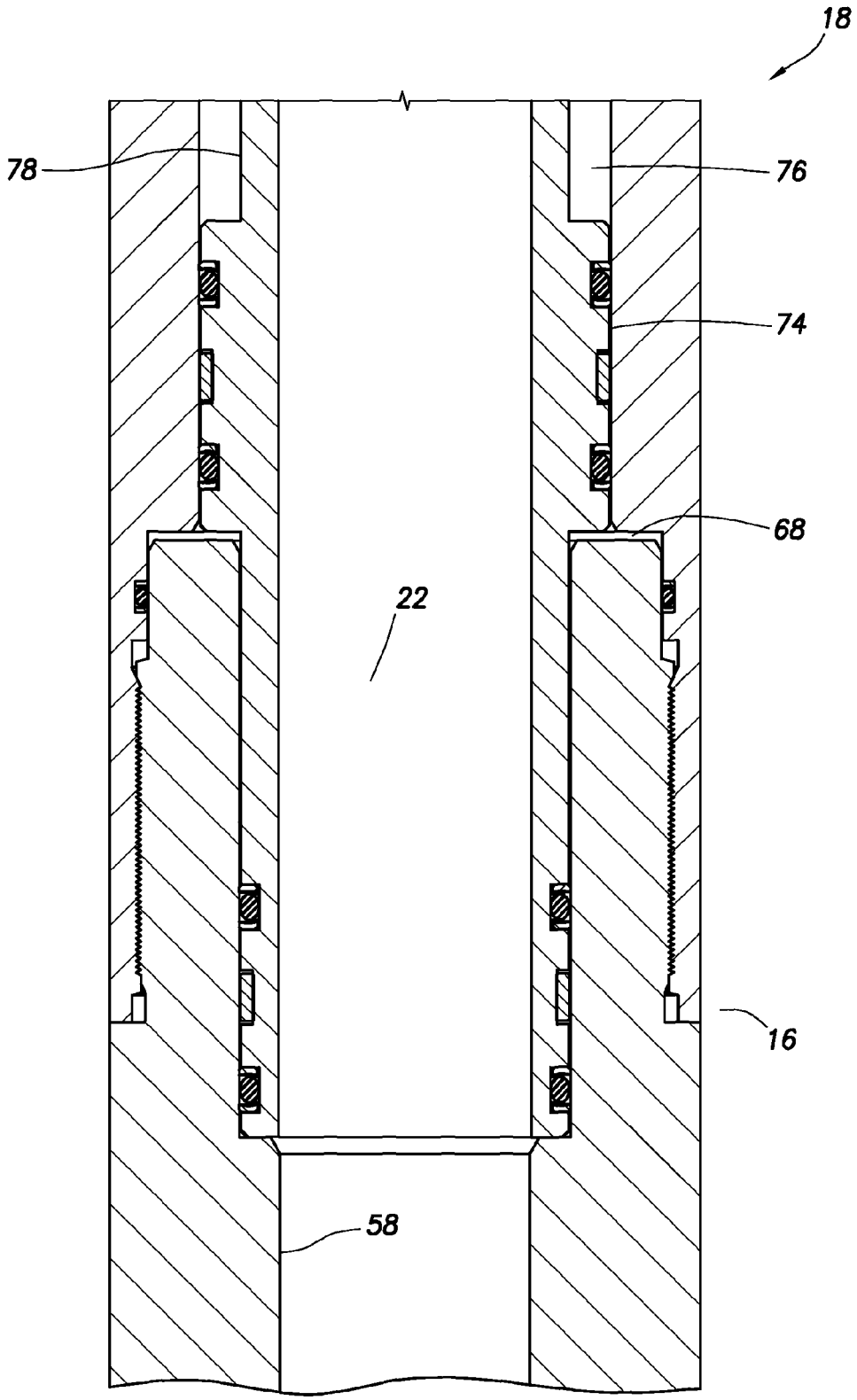

Referring additionally now to FIGS. 10A-C, another construction of the circulation control valve 18 is representatively illustrated in its run-in closed configuration. This example of the valve 18 is somewhat similar to the valve of FIGS. 7A-9D, in that a valve device 62 is opened in order to open the valve 18, and another valve device 64 (see FIG. 12B) is opened in order to close the valve 18.

However, in the example of FIGS. 10A-C, multiple relatively large diameter valve devices 62 are opened, which themselves provide fluid communication between the flow passage 22 and the annulus 16, without displacing the closure device 24. Instead, the valve devices 62 are opened in response to a predetermined differential pressure from the flow passage 22 to the annulus 16, and thereafter fluid communication is permitted through the valve devices between the flow passage and the annulus.

Figure 11A:
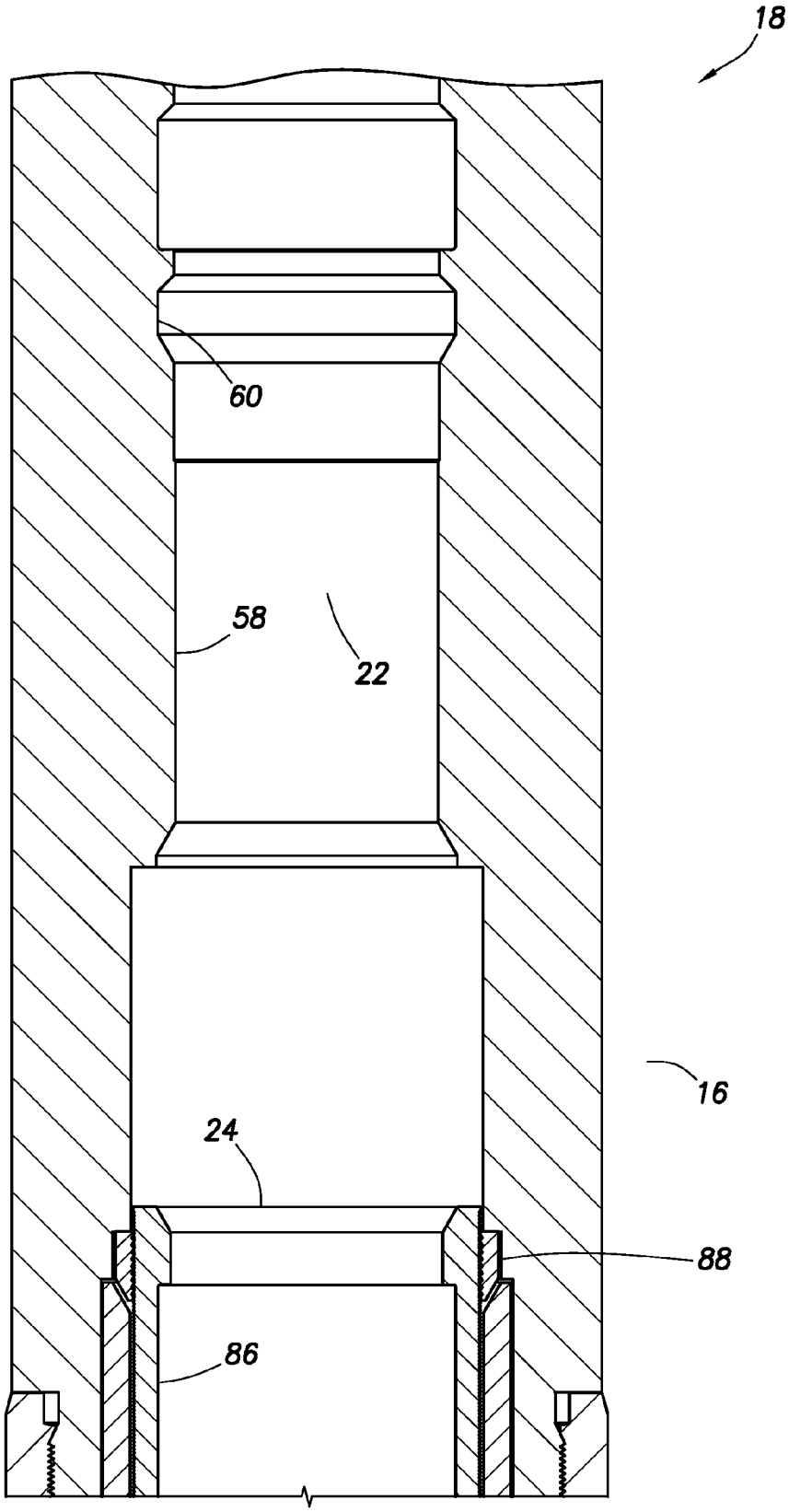
FIGS. 11A-C are cross-sectional views of successive axial sections of the valve of FIGS. 10A-C, the valve being depicted in an open circulating configuration.
Figure 11B:
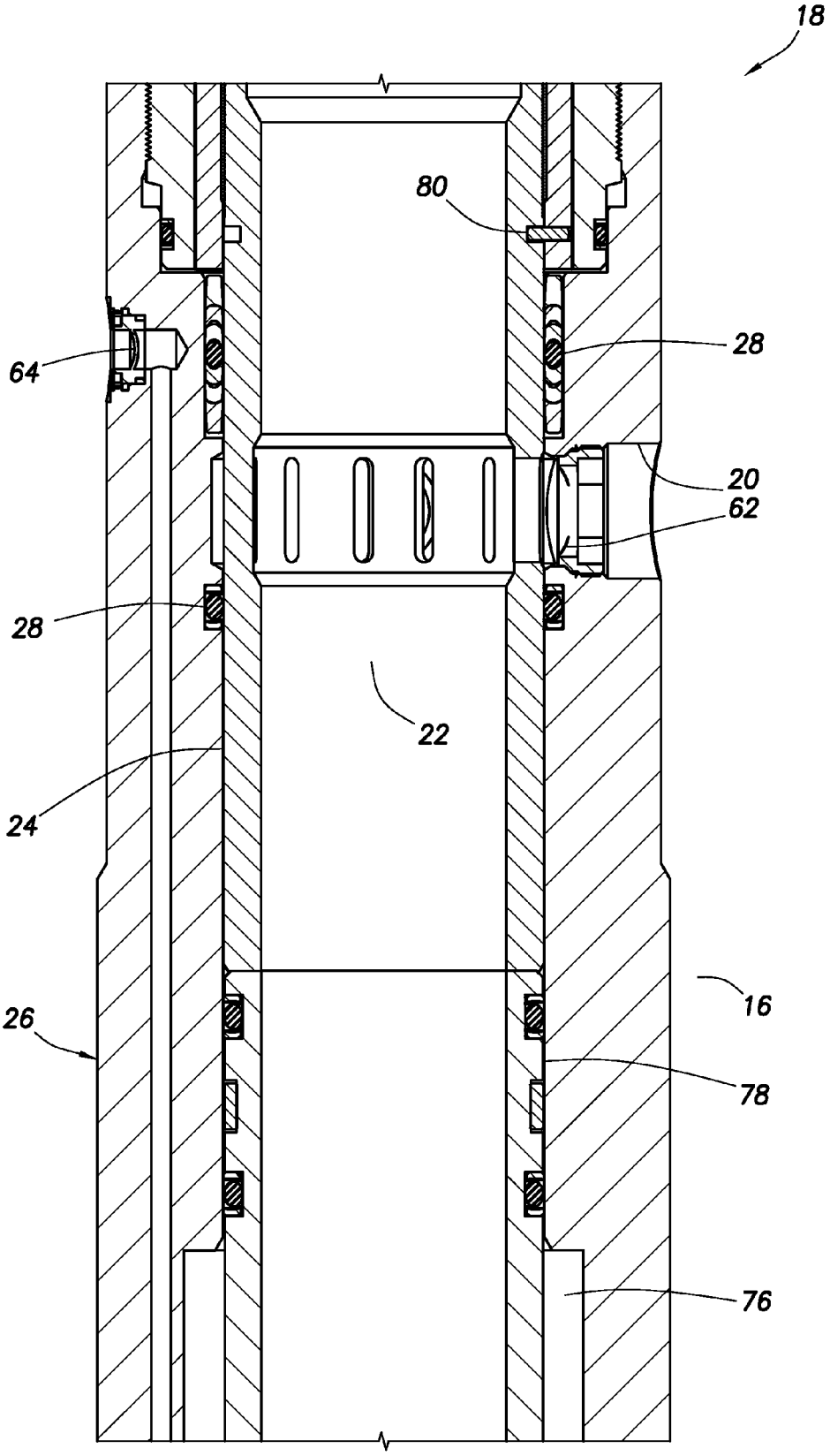
Figure 11C:
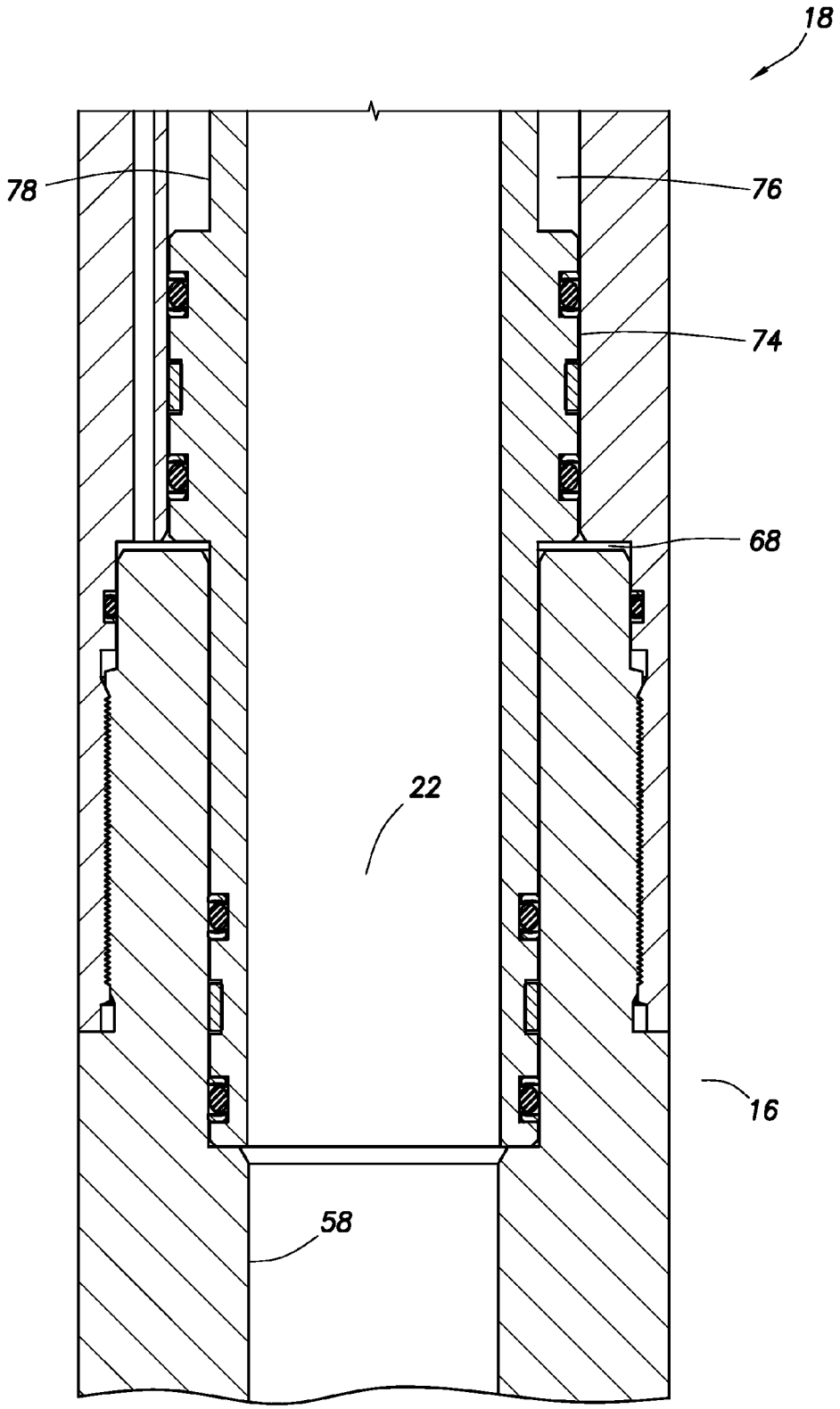

In FIGS. 11A-C, the valve 18 is representatively illustrated after the valve devices 62 have been opened. Note that this cross-section of the valve 18 is rotated 90 degrees about the longitudinal axis of the valve, so that various other features of the valve (such as the valve device 64) may be clearly seen.

The closure device 24 is maintained in the same position as it was in FIGS. 10A-C by shear pins 80. Note also, that the open valve devices 62 provide a relatively large flow area for flowing fluid between the passage 22 and the annulus 16.

Figure 12A:
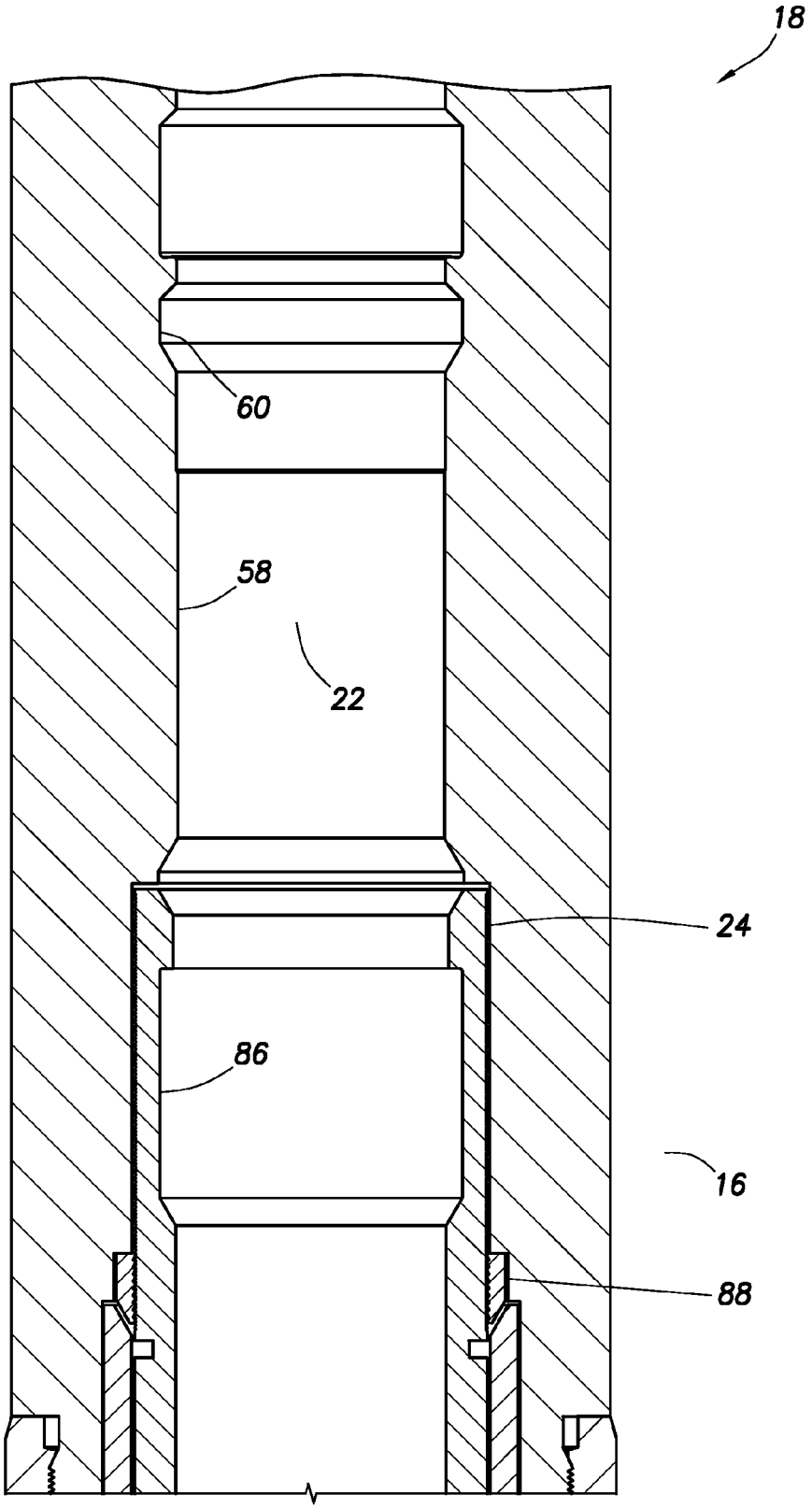
FIGS. 12A-C are cross-sectional views of successive axial sections of the valve of FIGS. 10A-C, the valve being depicted in a subsequent closed configuration.
Figure 12B:
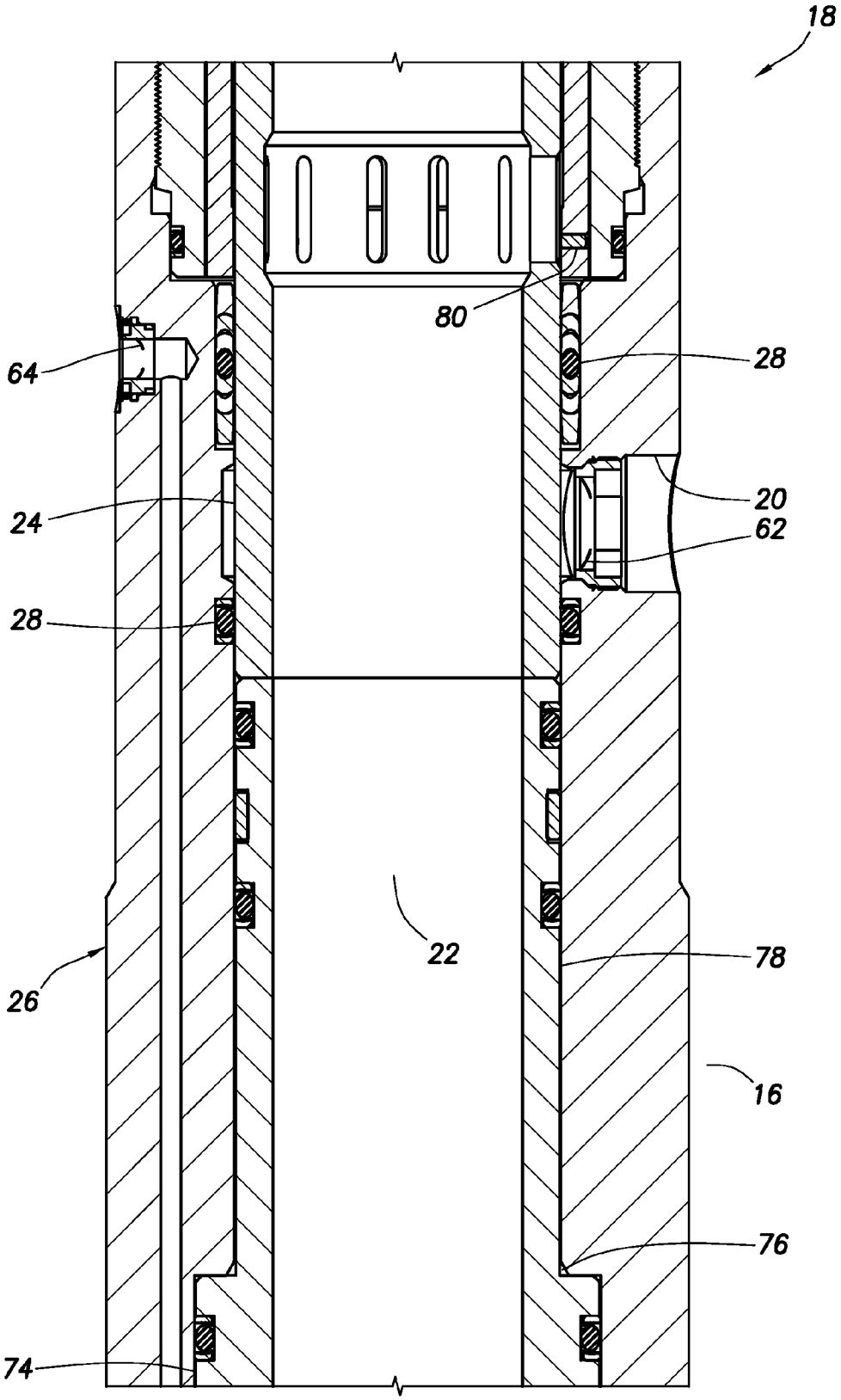
Figure 12C:
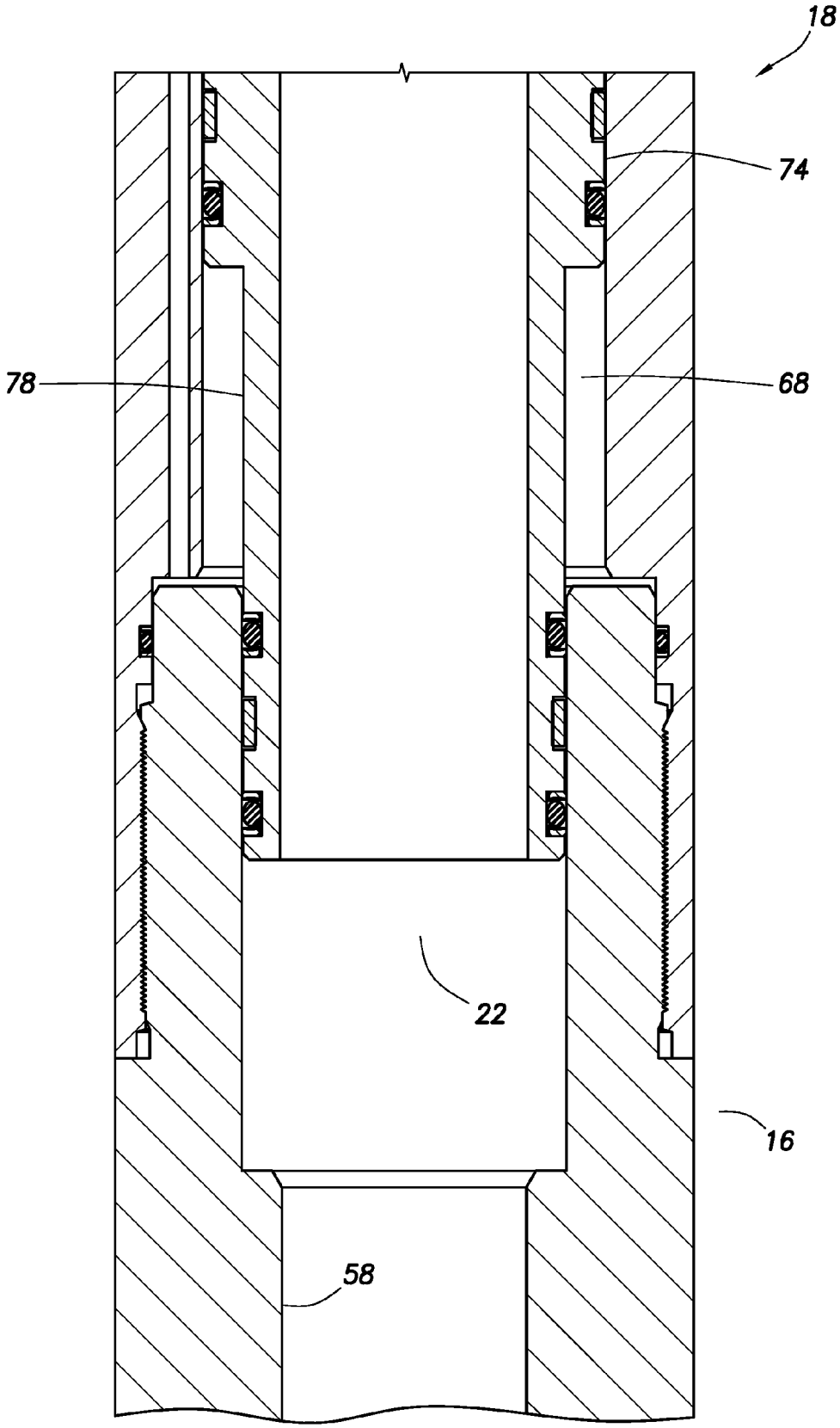

In FIGS. 12A-C, the valve 18 is shown after pressure has been increased to thereby open the valve device 64. As with the valve 18 of FIGS. 9A-C, this opening of the valve device 64 causes the sleeve 78 to displace upward, thereby shearing the shear pins 80, and displacing the closure device 24 upward to close off the openings 20. Also, since the valve device 64 is exposed to the annulus 16 and not to the passage 22 prior to the opening of the valve devices 62, the valve device 64 is unaffected by pressure in the passage 22 until after the valve devices 62 are opened.

A slip-type ratchet locking device 88 maintains the closure device 24 in its closed position as depicted in FIG. 12A. At any time it is desired to close the valve 18, a conventional shifting tool (not shown) can be engaged with the profile 86 and upward force thereby applied to shear the shear pins 80 and displace the closure device 24 upward.

Figure 13A:
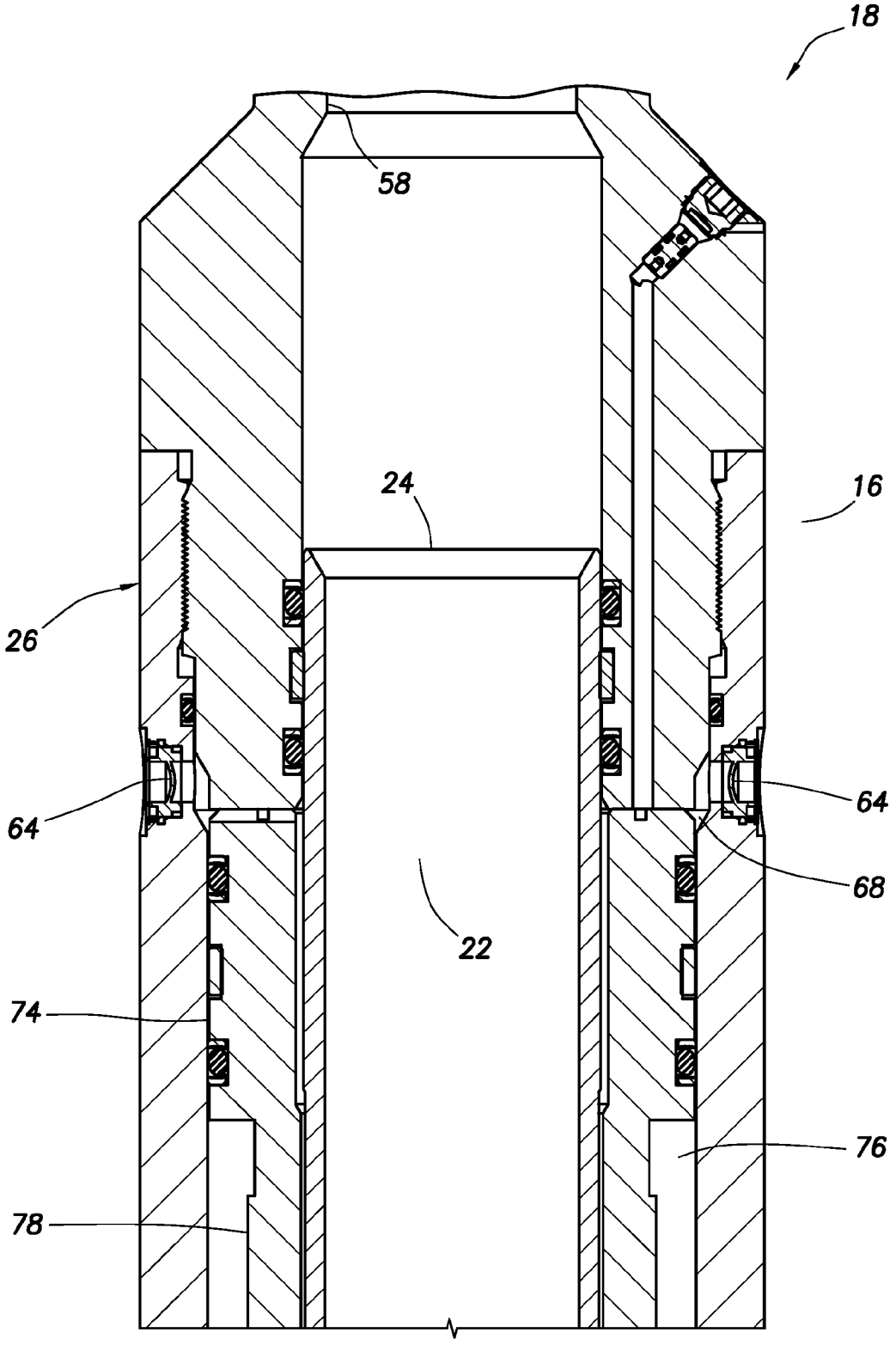
FIGS. 13A-C are cross-sectional views of successive axial sections of another construction of the circulation control valve which may be used in the well system and method of FIG. 1, the valve being depicted in a run-in closed configuration.
Figure 13B:
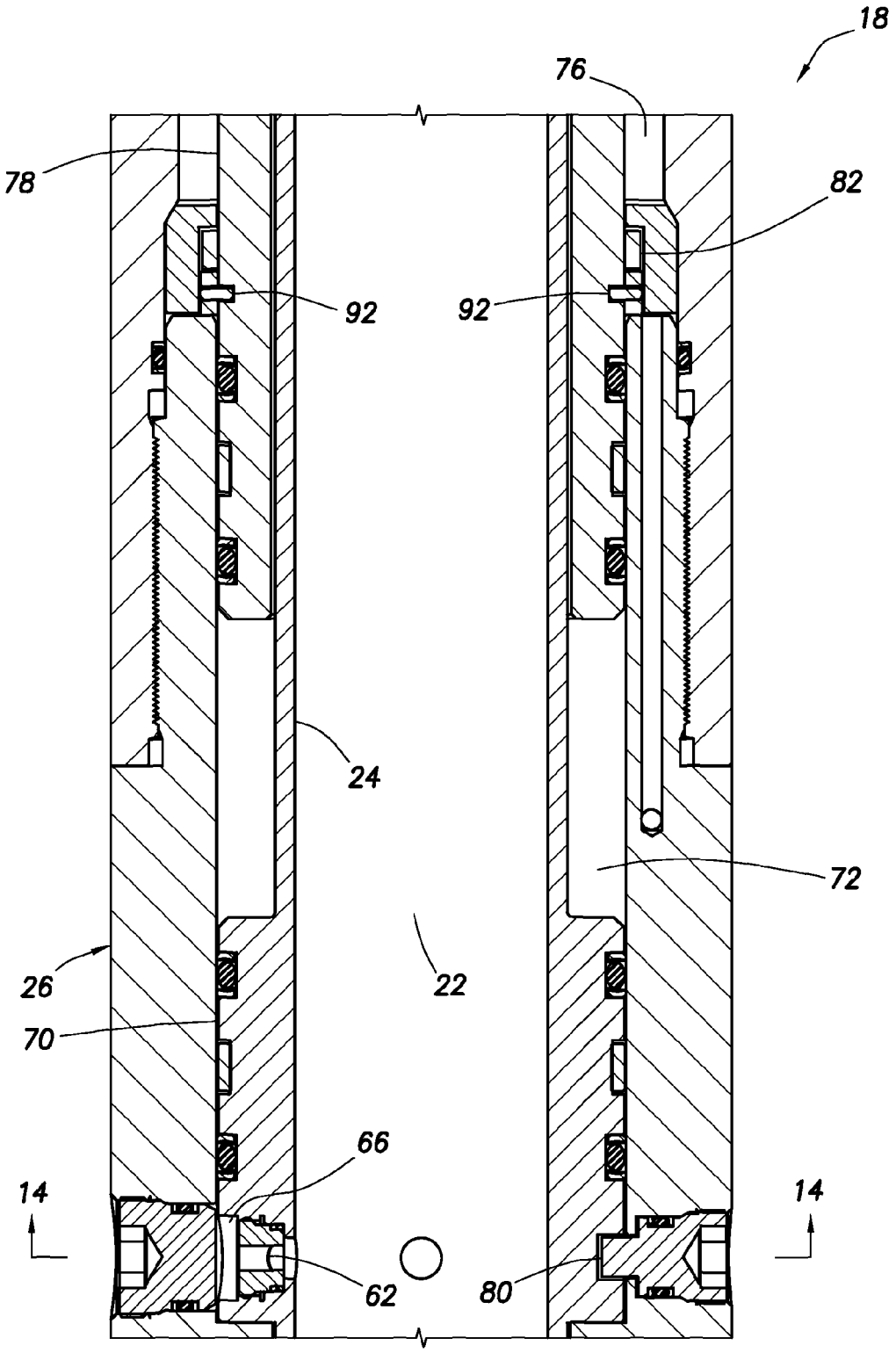
Figure 13C:
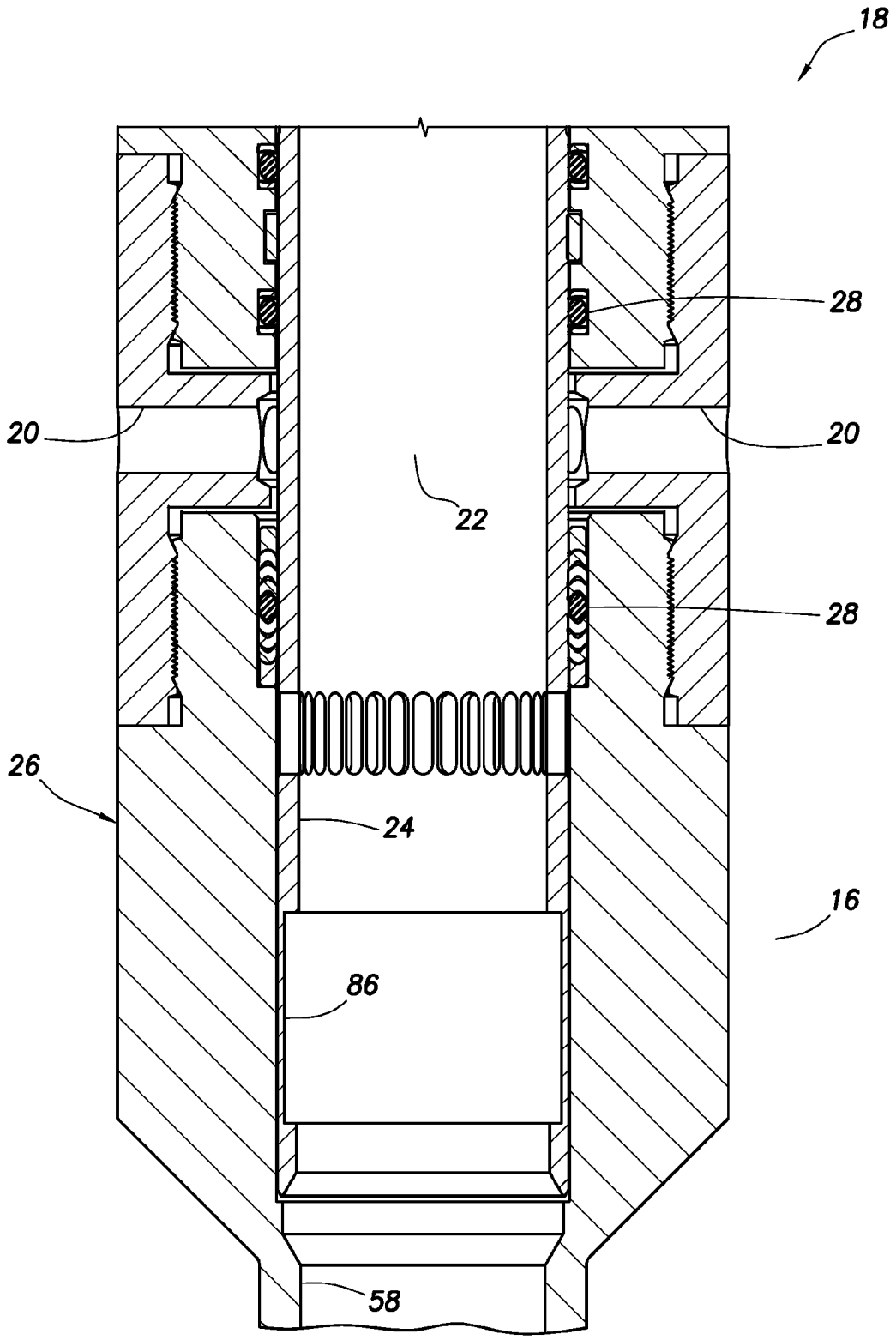

Referring additionally now to FIGS. 13A-C, another construction of the circulation control valve 18 is representatively illustrated in its closed run-in configuration. This example of the valve 18 is similar in many respects to the example of FIGS. 7A-9C, but the closure device 24 in the example of FIGS. 13A-C displaces upwardly to open the valve (uncovering the openings 20), and the sleeve 74 displaces downwardly to shift the closure device back downwardly to close the valve. Otherwise, the operation of the valve 18 is fundamentally the same.

Figure 14:
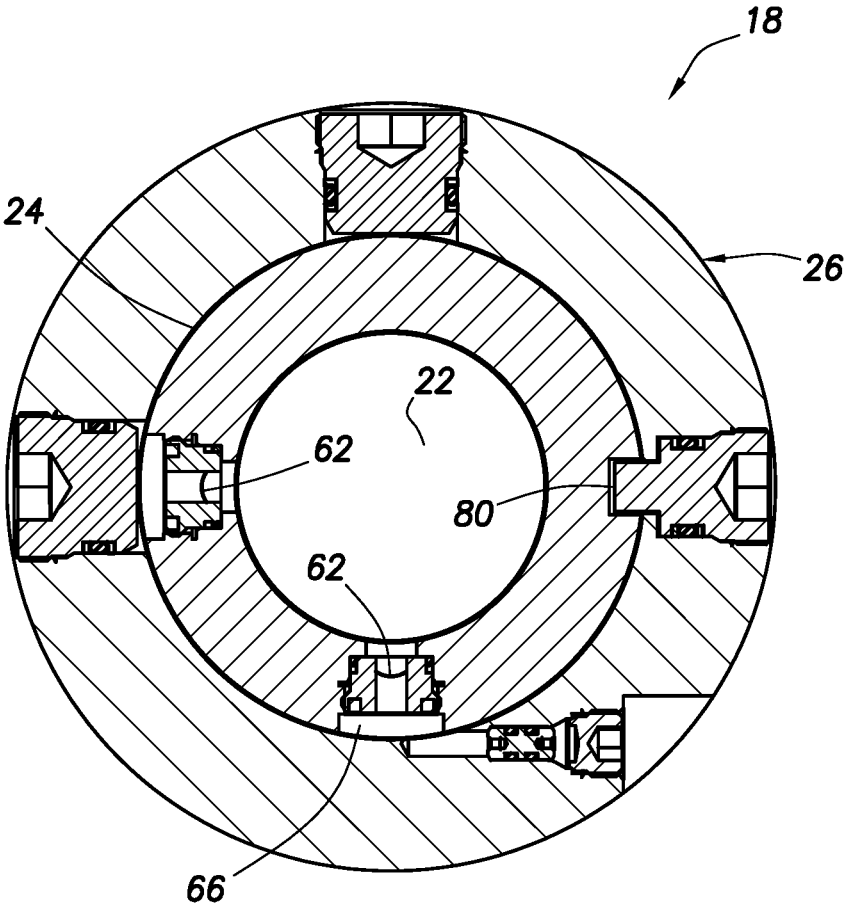
FIG. 14 is a cross-sectional view of the valve of FIGS. 13A-C, taken along line 14-14 of FIG. 13B.

In FIG. 14, the arrangement of valve devices 62 about the closure device 24 may be seen in more detail. The chambers 66, 72 initially contain a relatively low pressure (such as atmospheric pressure). When pressure in the passage 22 exceeds a predetermined value, the valve devices 62 open, thereby exposing the chamber 66 to the increased pressure.

Figure 15A:
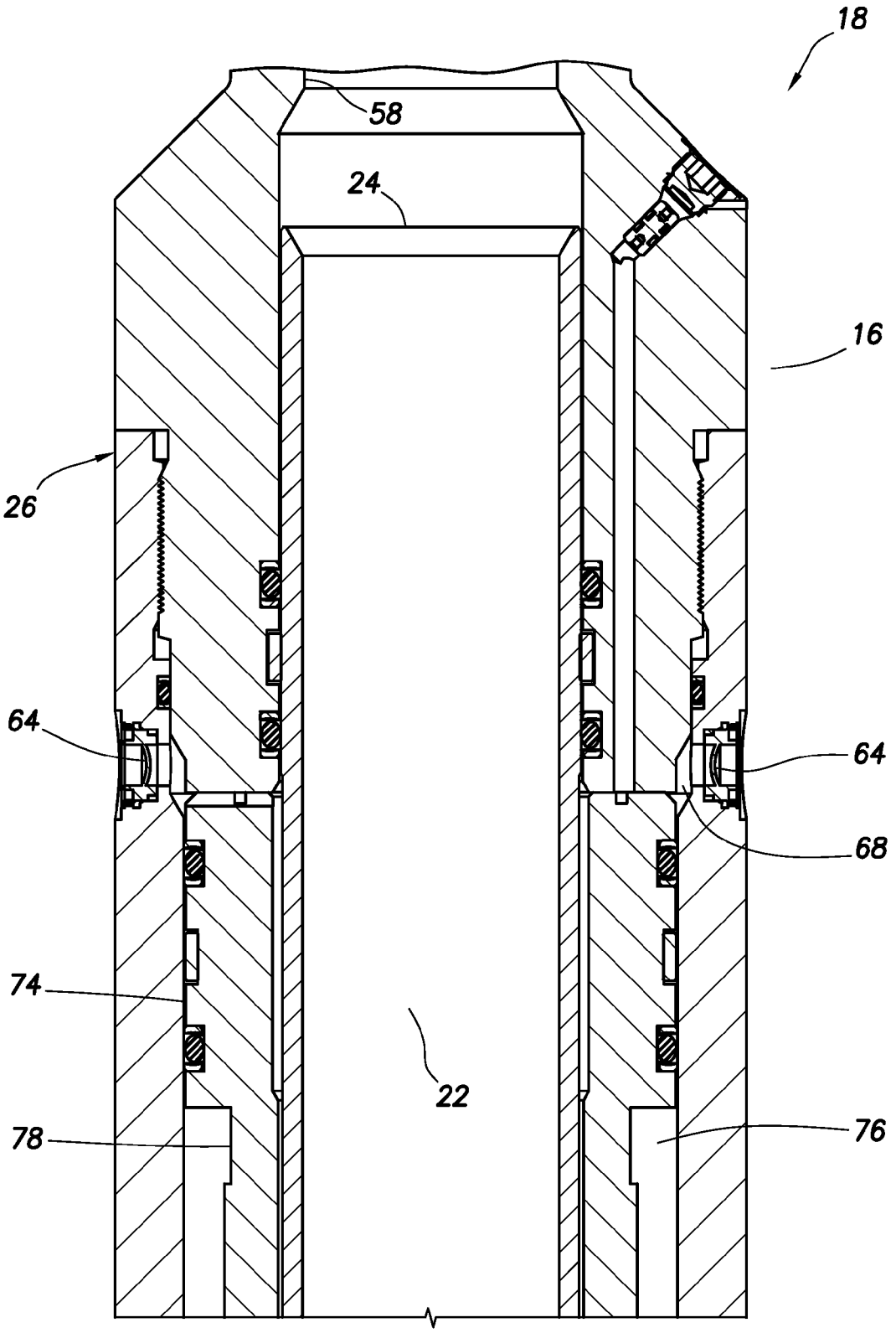
FIGS. 15A-C are cross-sectional views of successive axial sections of the valve of FIGS. 13A-C, the valve being depicted in an open circulating configuration.
Figure 15B:
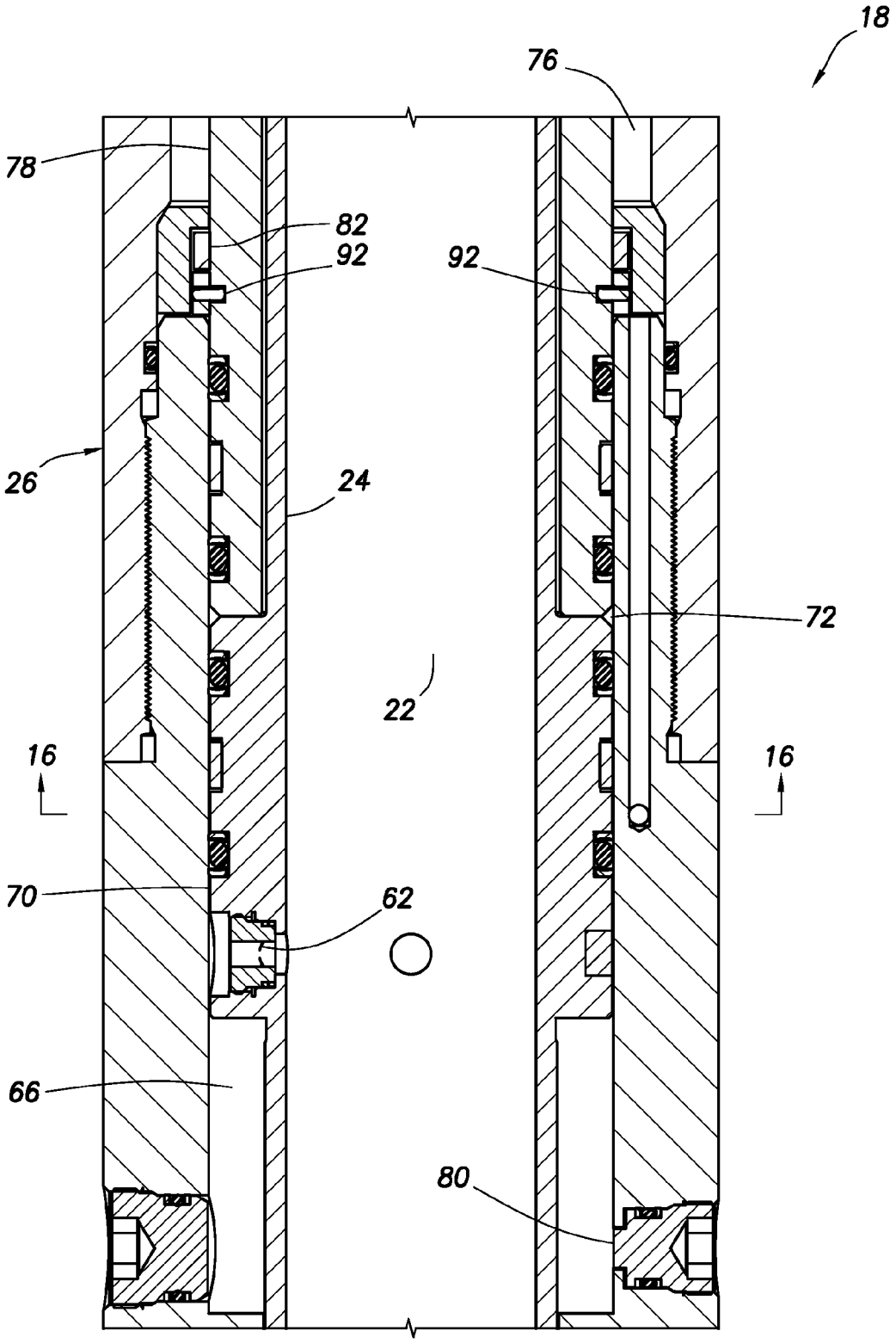
Figure 15C:
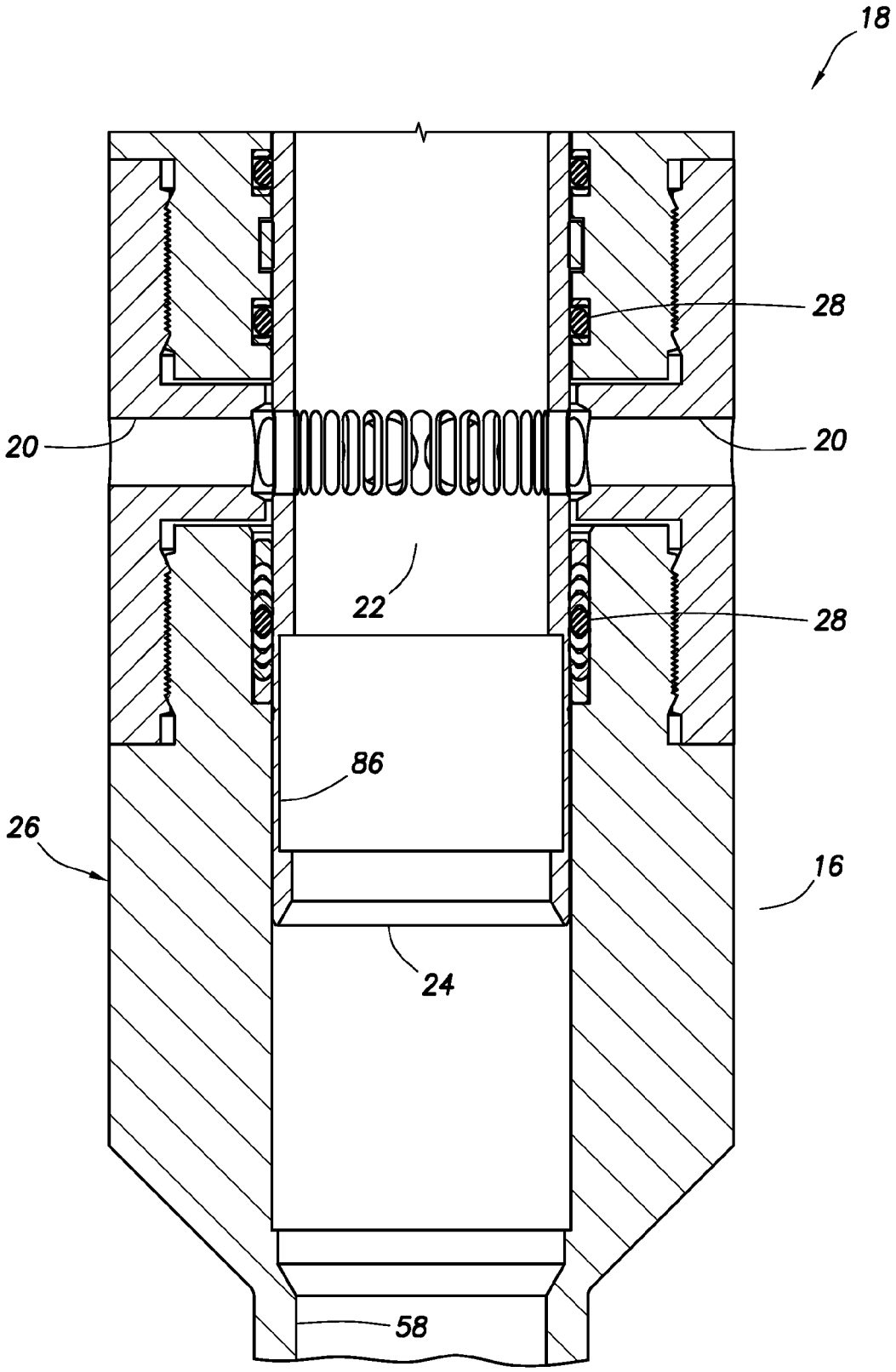

In FIGS. 15A-C, the valve 18 is representatively illustrated in its open configuration, after the valve devices 62 have opened. The resulting pressure differential across the piston 70 causes the closure device 24 to displace upwardly, thereby uncovering the openings 20.

Figure 16:
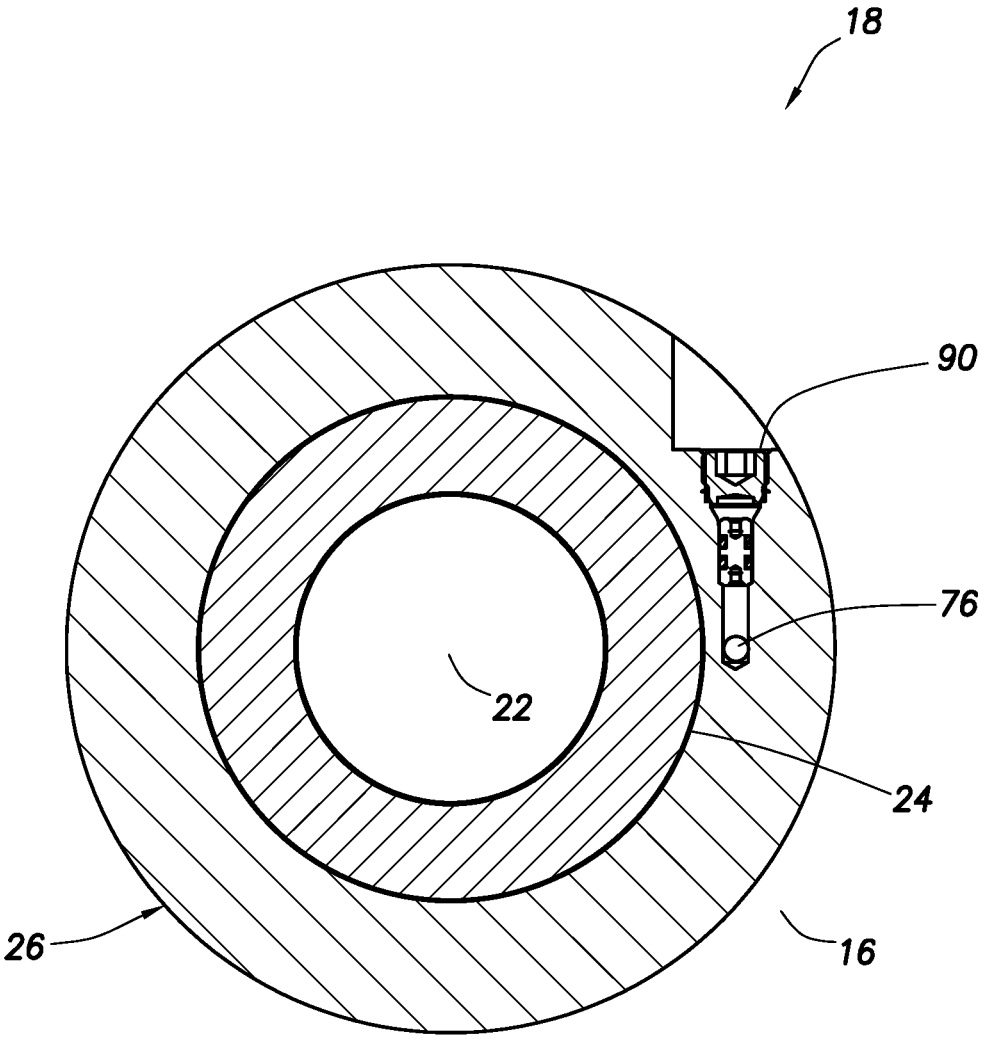
FIG. 16 is a cross-sectional view of the valve of FIGS. 15A-C, taken along line 16-16 of FIG. 15B.

In FIG. 16, it may be seen that the chamber 76 extends to a fill/pressure relief port 90. Pressure in the chamber 76 is initially relatively low (such as atmospheric pressure).

Figure 17A:
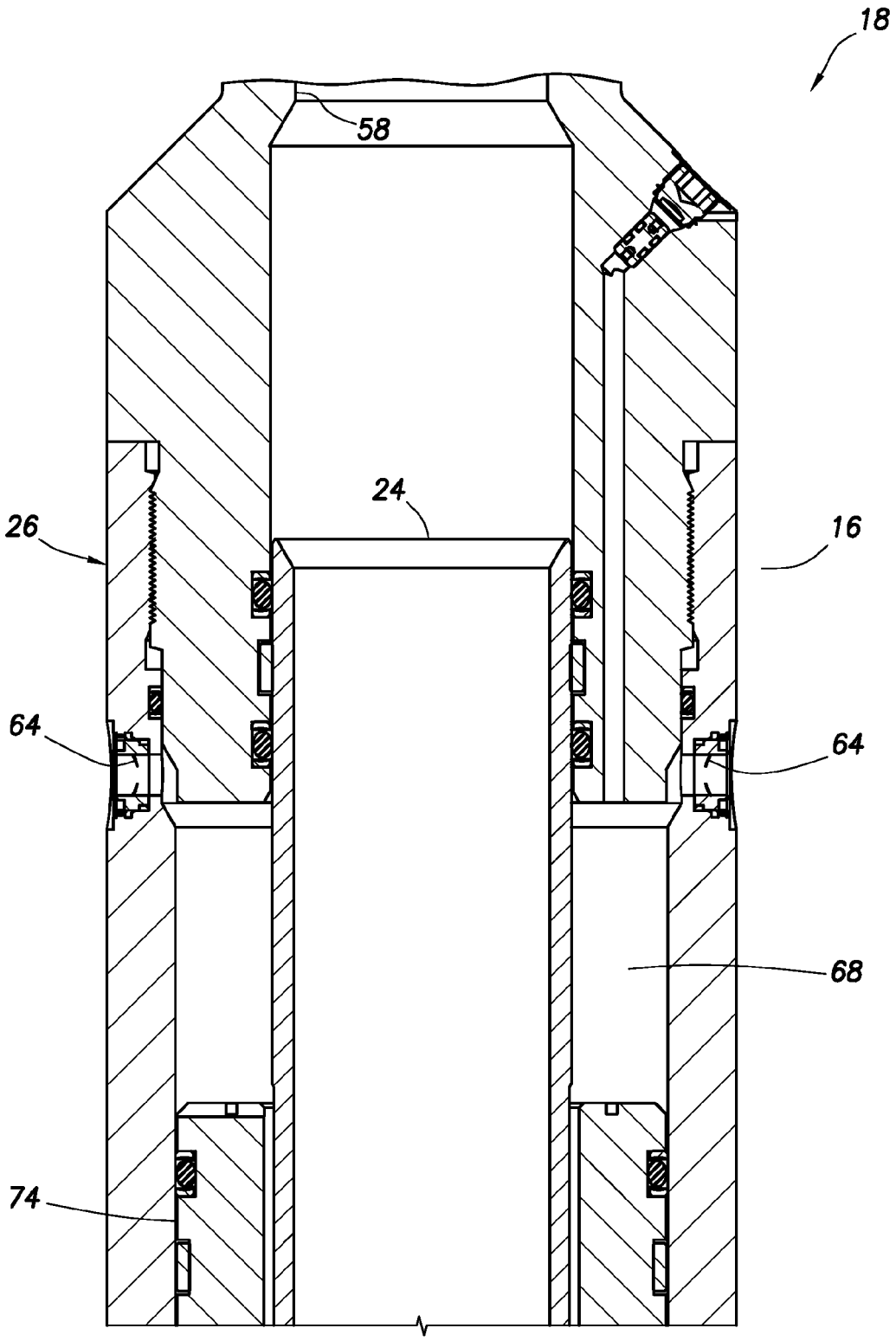
FIGS. 17A-C are cross-sectional views of successive axial sections of the valve of FIGS. 13A-C, the valve being depicted in a subsequent closed configuration.
Figure 17B:
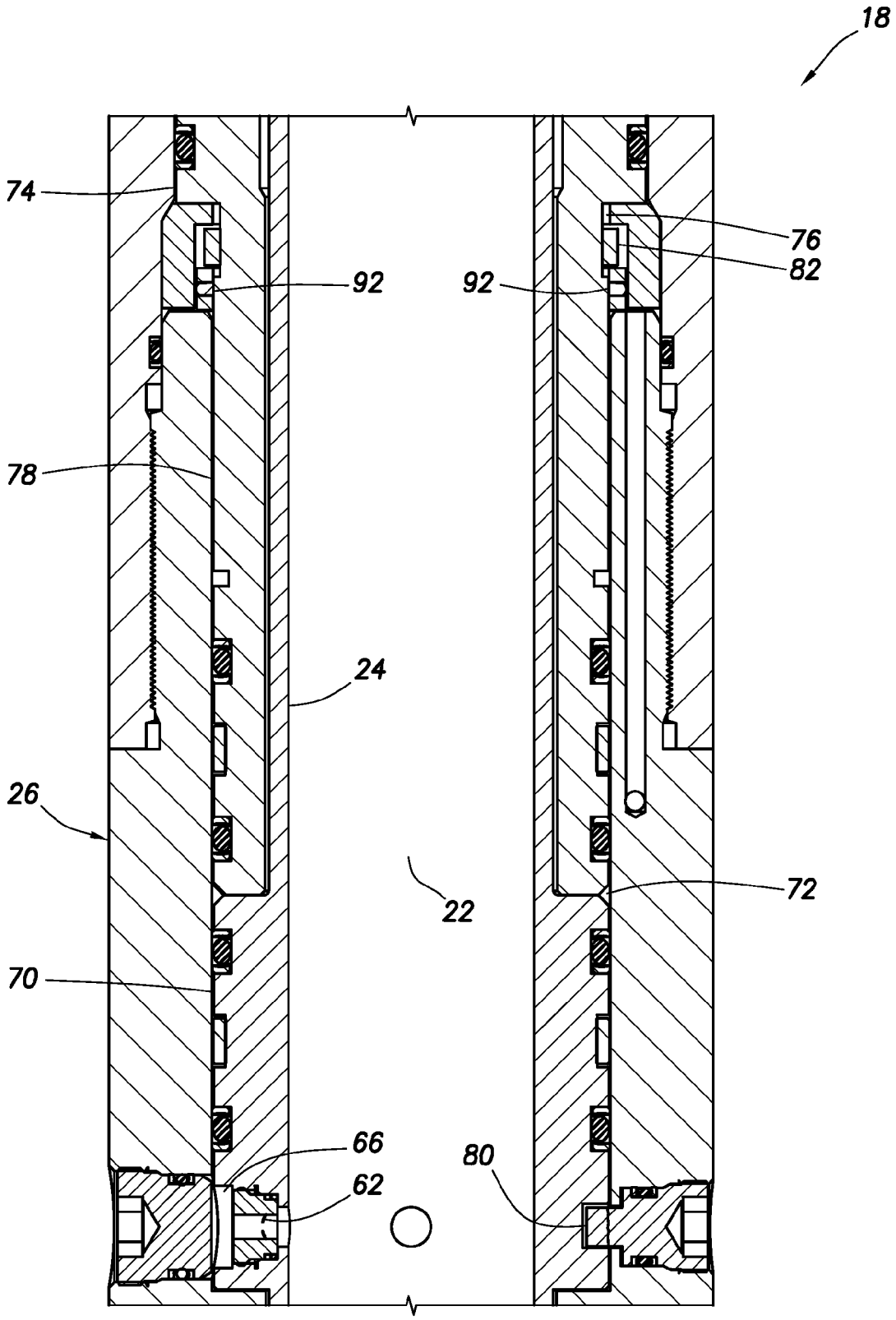
Figure 17C:
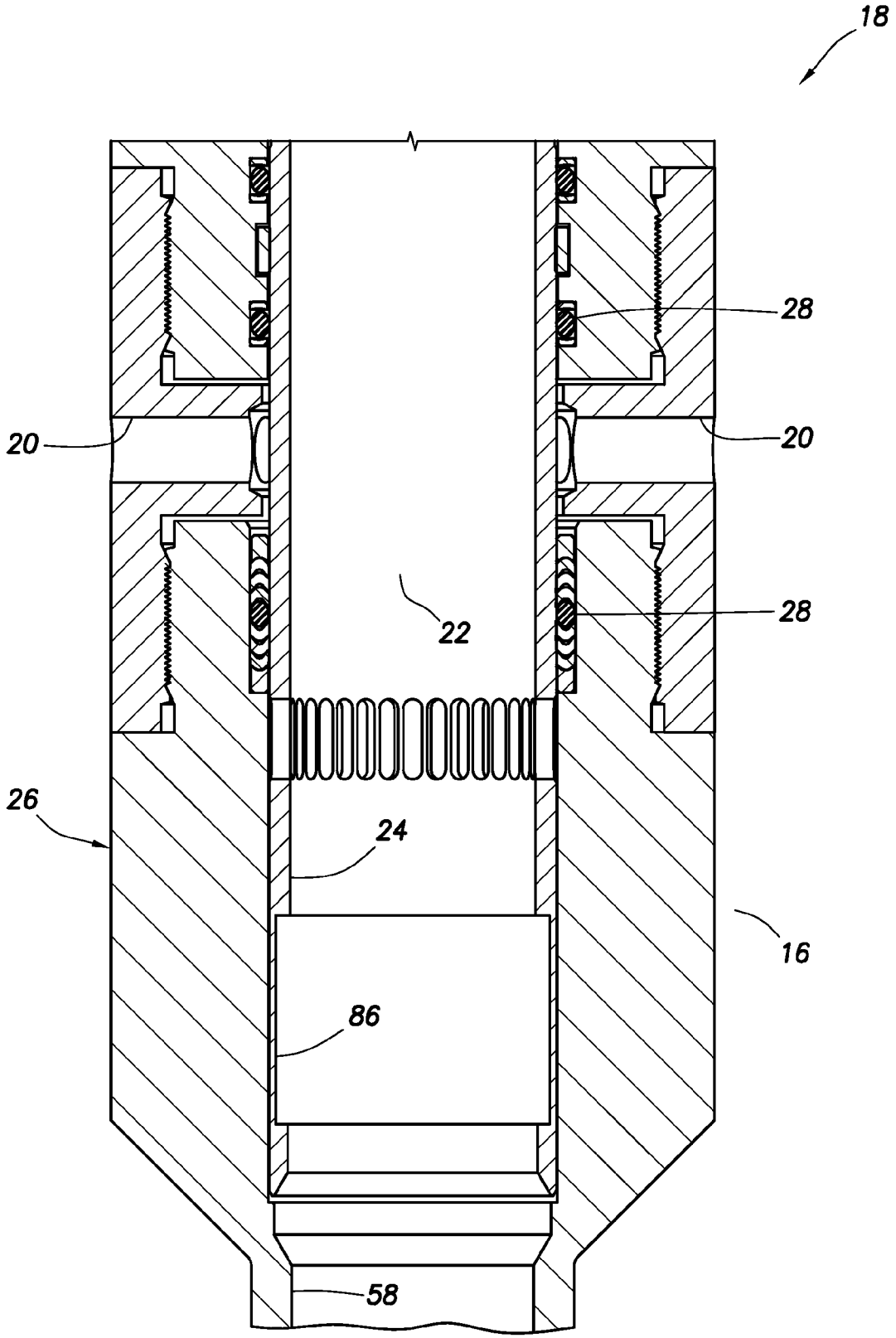

In FIGS. 17A-C, the valve is shown in its closed configuration after the valve devices 64 have been opened. The valve devices 64 are opened by increasing pressure in the annulus 16 to a predetermined level (i.e., to achieve a predetermined pressure differential from the annulus to the chamber 68), either by pressurizing the annulus or the passage 22 (since they are in communication via the openings 20).

The sleeve 78 has displaced downward due to the pressure differential from the chamber 68 to the chamber 76, shearing shear pins 92. This downward displacement of the sleeve 78 also causes the closure device 24 to displace downward (since the differential piston area on the piston 74 is greater than the differential piston area on the piston 70).

Figure 18:
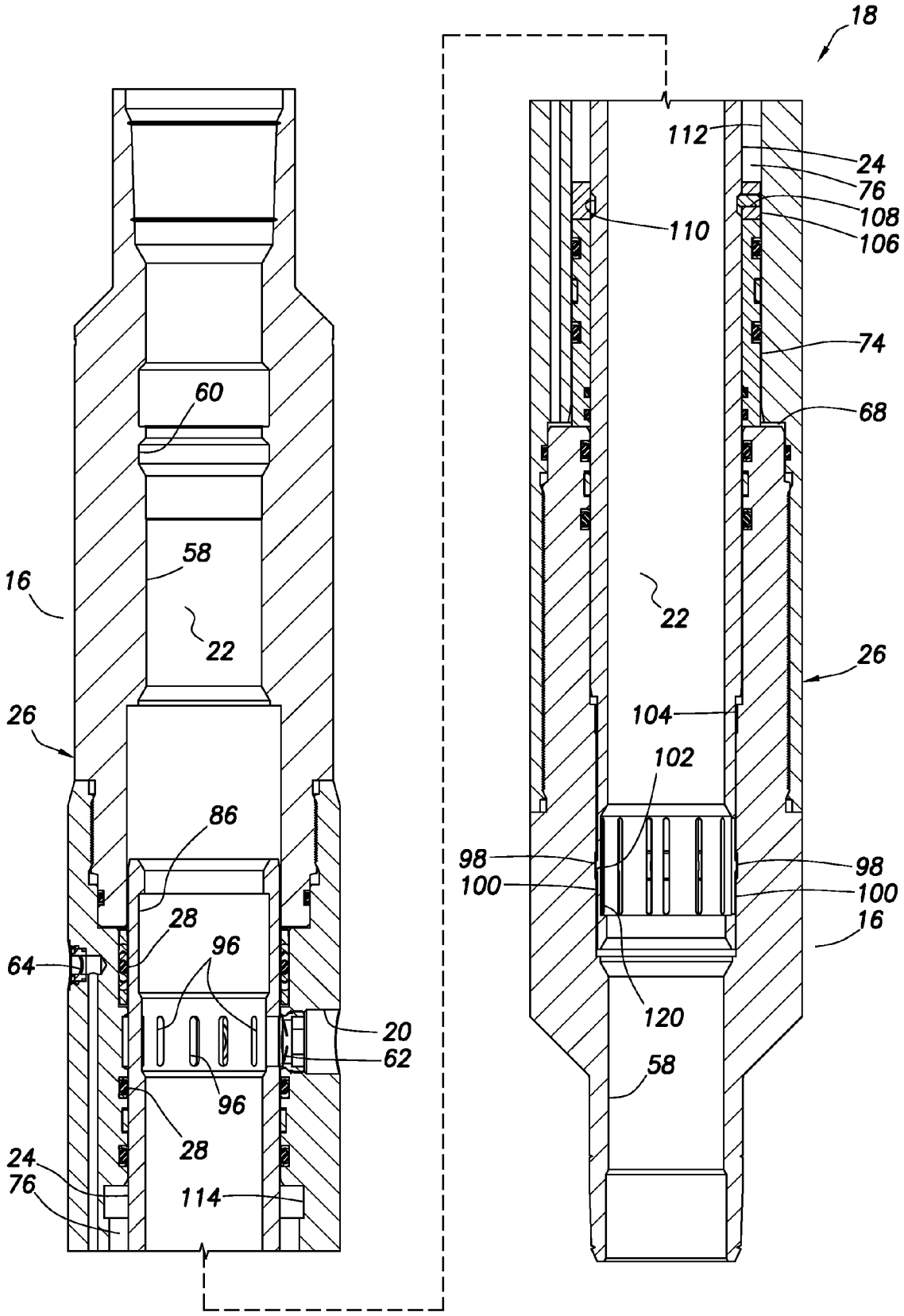
FIG. 18 is a cross-sectional view of another construction of the valve, with the valve being depicted in a pressure-opened configuration.

Referring additionally now to FIG. 18, another construction of the circulation control valve 18 is representatively illustrated. The valve 18 of FIG. 18 is similar in many respects to the valves of FIGS. 10A-12C and FIGS. 13A-17C, in that it may be opened and then closed by application of pressure to the valve. However, the valve 18 of FIG. 18 may subsequently (after pressure operation) be opened and closed mechanically (e.g., by use of a mechanical shifting tool).

As depicted in FIG. 18, the valve devices 62 have already been opened in response to application of a predetermined pressure differential from the passage 22 to the annulus 16. Relatively unrestricted fluid communication is now permitted between the passage 22 and the annulus 16 via the openings 20 in the housing assembly 26 and openings 96 in the closure device 24. Engagement between an annular recess 102 formed in the housing assembly 26 and projections 98 on resilient collets 100 formed on the closure device 24 prevents the closure device from inadvertently displacing during run-in and opening of the valve devices 62.

In order to pressure-close the valve 18, a predetermined pressure may be applied to the valve device 64 to open the valve device and thereby permit fluid communication between the annulus 16 and the chamber 68 below the piston 74. With the valve devices 62 open, pressure is the same in the passage 22 and the annulus 16, but prior to opening the valve devices 62, the valve device 64 is preferably isolated from pressure in the passage 22, and so it is not necessary for the pressure used to open the valve devices 62 to be greater than pressure used to open the valve device 64.

Figure 19:
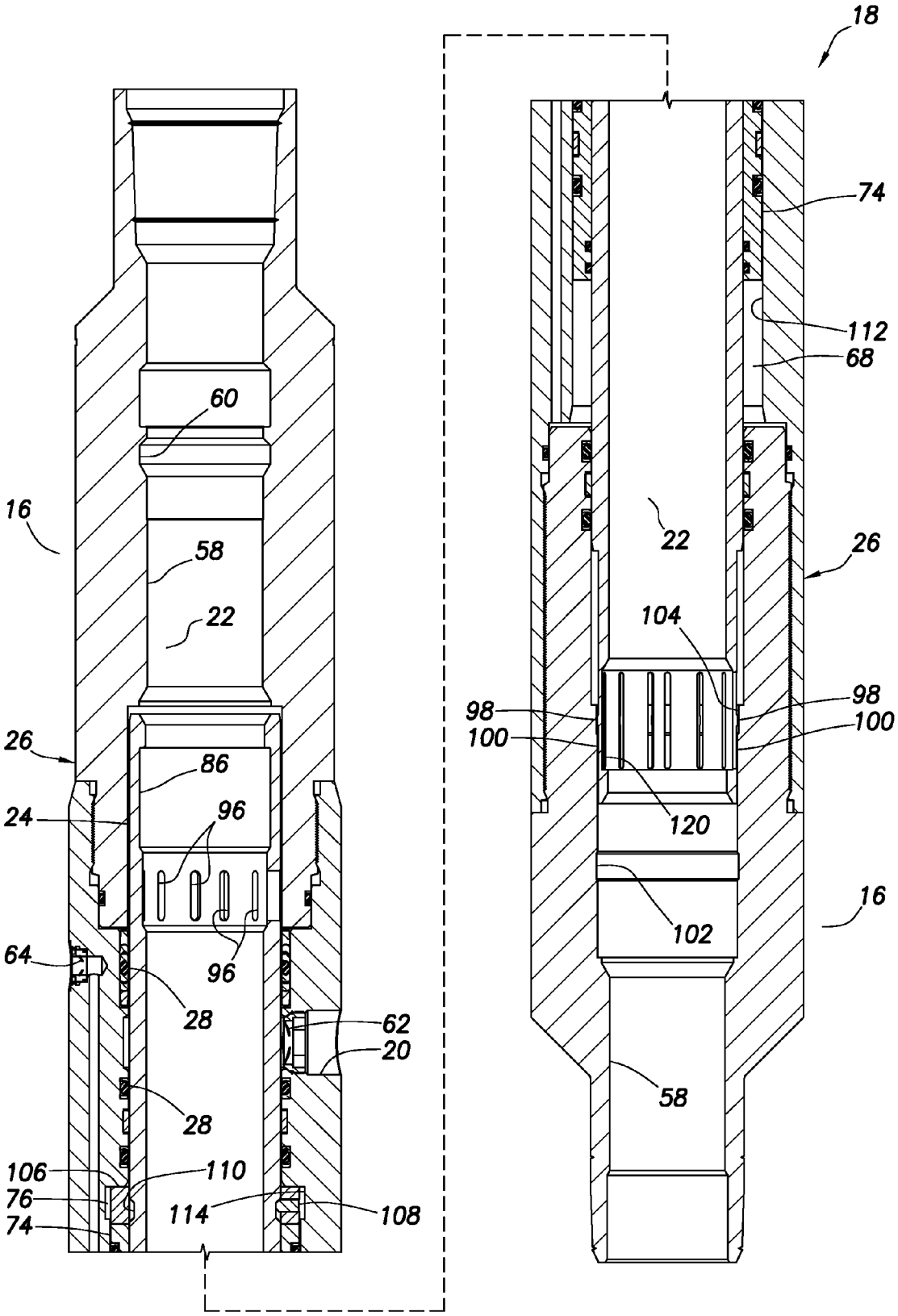
FIG. 19 is a cross-sectional view of the valve of FIG. 18, with the valve being depicted in a pressure-closed configuration.

Referring additionally now to FIG. 19, the valve 18 is representatively illustrated in a closed configuration. The valve device 64 has been opened by applying pressure to the annulus 16 and/or passage 22, whereby the pressure is communicated to the chamber 68 and the piston 74 is biased upward due to the pressure differential from the chamber 68 to the chamber 76.

The openings 20 are now closed off by the closure device 24. The projections 98 on the collets 100 now engage another recess 104 in the housing assembly 26, thereby preventing inadvertent downward displacement of the closure device 24.

Note that the piston 74 is in the form of a sleeve which encircles the closure device 24. When the piston 74 is biased upward due to the pressure differential from the chamber 68 to the chamber 76, the piston pushes against a ring 106 which is releasably secured to the closure device 24 by engagement of multiple lugs 108 (only one of which is visible in FIGS. 18-21) in a recess 110 formed on the closure device.

When the closure device 24 is in its downwardly disposed open position (as depicted in FIG. 18), the lugs 108 are maintained in engagement with the recess 110 by an inner cylindrical wall 112 of the housing assembly 26. The wall 112 corresponds to an outer diameter of the chamber 68 which is sealingly engaged by the piston 74.

However, when the closure device is in its upwardly disposed closed position (as depicted in FIG. 19), the lugs 108 are no longer retained in engagement with the recess 110, since the lugs are now able to displace radially outward into a radially enlarged recess 114 formed in the housing assembly 26. At this point, the closure device 24 can be displaced independently of the piston 74, ring 106 and lugs 108.

Figure 20:
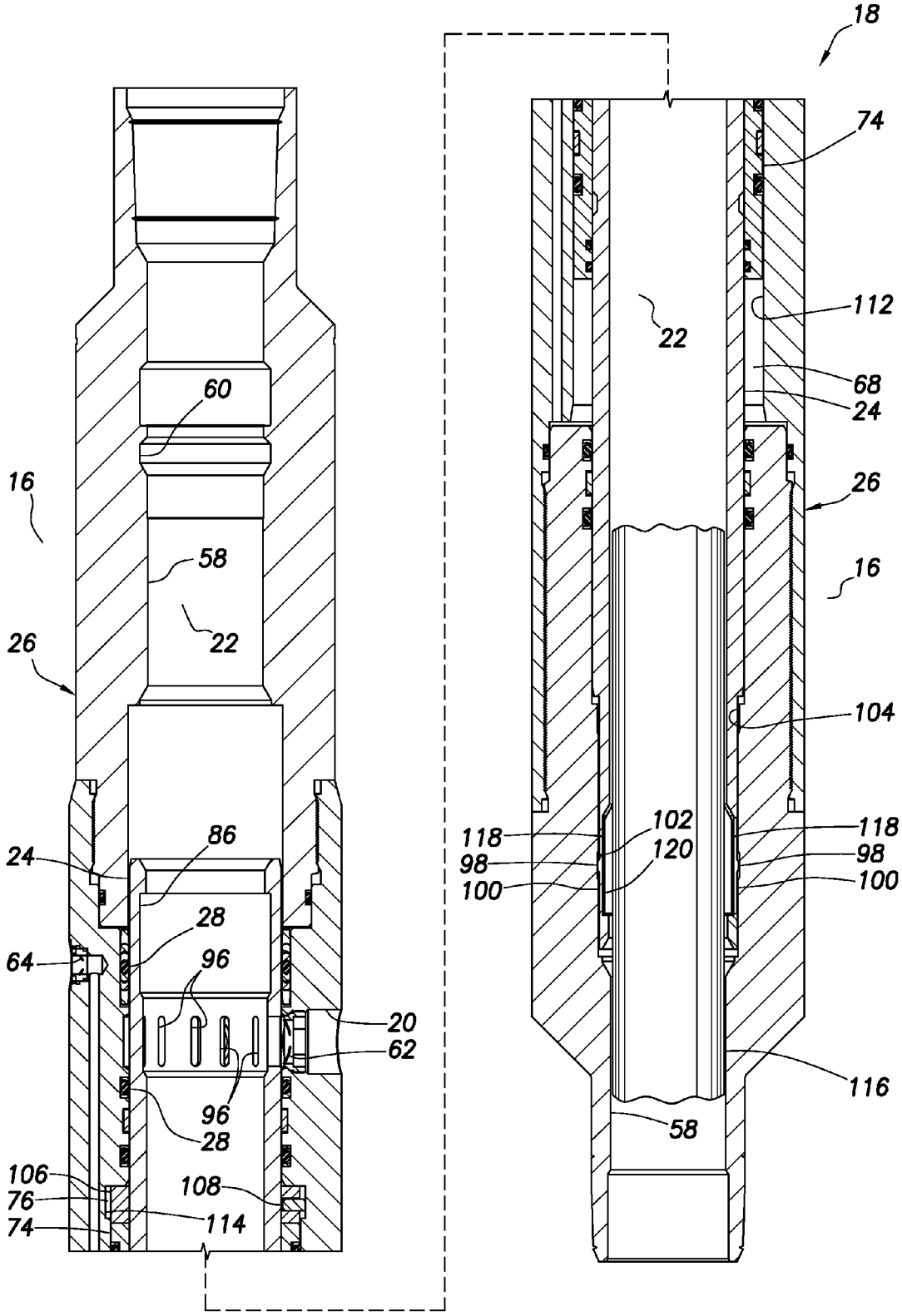
FIG. 20 is a cross-sectional view of the valve of FIGS. 18 & 19, with the valve being depicted in a mechanically shifted-open configuration.

Referring additionally now to FIG. 20, the valve 18 is representatively illustrated in a mechanically shifted-open configuration. A shifting tool 116 has been conveyed into the valve 18 via the passage 22 and shifting dogs 118 on the tool have engaged a profile 120 formed in the closure device 24 to thereby apply a downwardly directed force to the closure device, in order to displace the closure device downwardly to its open position.

Thus, the valve 18 can be opened mechanically after it has been closed by pressure. The projections 98 on the collets 100 again engage the recess 102 to prevent inadvertent displacement of the closure device 24.

Figure 21:
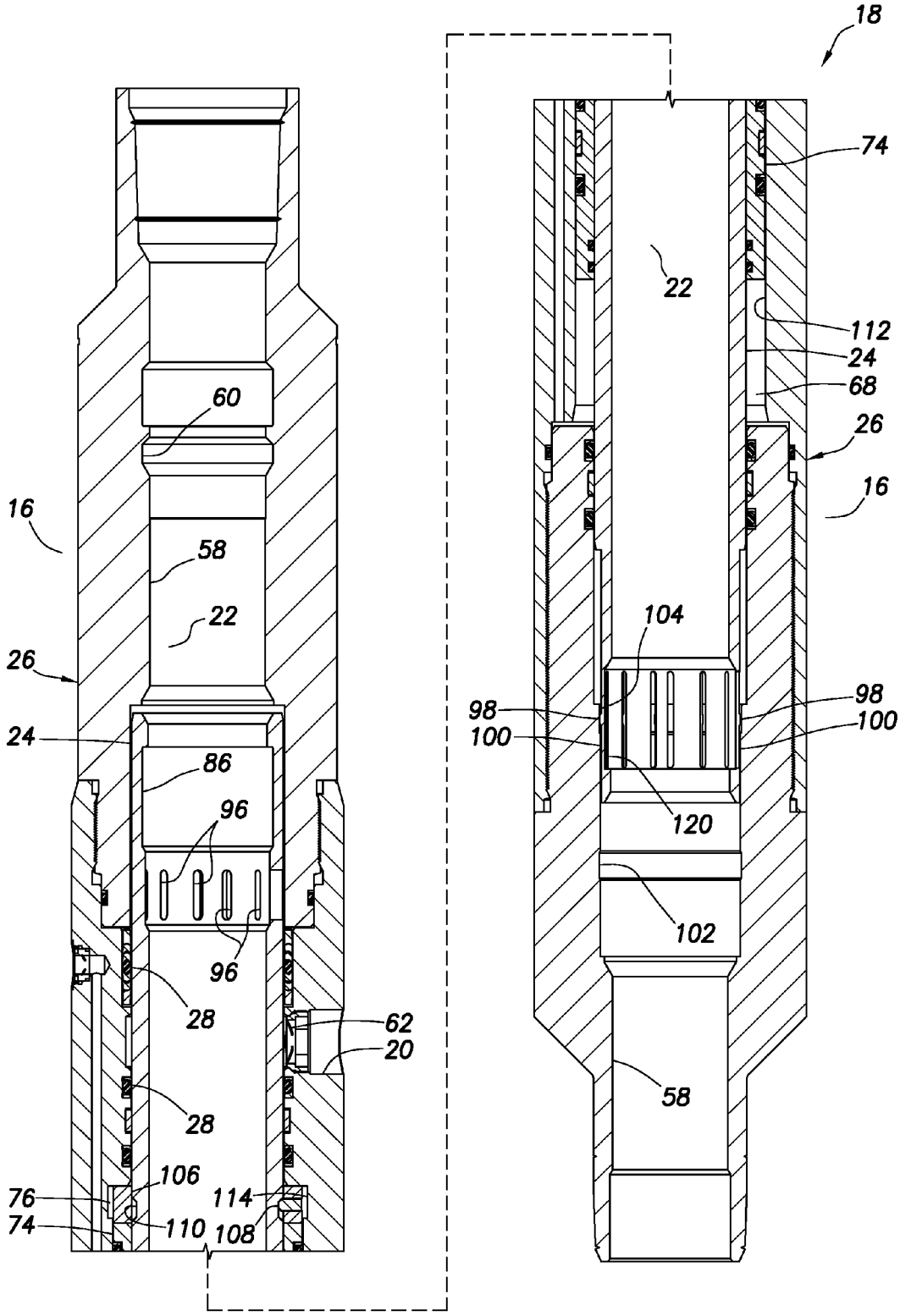
FIG. 21 is a cross-sectional view of the valve of FIGS. 18-20, with the valve being depicted in a mechanically shifted-closed configuration.

Referring additionally now to FIG. 21, the valve 18 is representatively illustrated in a mechanically shifted-closed configuration. A shifting tool (such as the shifting tool 116 described above and depicted in FIG. 20) may be used to engage the profile 86 and displace the closure device 24 upward, so that the closure device again prevents fluid communication between the passage 22 and the annulus 16 via the openings 20.

The closure device 24 may be mechanically displaced between its open and closed positions as depicted in FIGS. 20 and 21 any number of times. The projections 98 will alternately engage the recesses 102, 104 when the closure device 24 is displaced to its respective open and closed positions. Note that, in each of its mechanically operated displacements, the piston 74 does not displace with the closure device 24 (due to the lugs 108 no longer being retained in the recess 110), but instead is maintained in its upwardly disposed position by the pressure differential from the chamber 68 to the chamber 76.

It may now be fully appreciated that the above description of the circulation control valve 18 configurations provides significant improvements in the art. The valve 18 is capable of reliably and conveniently providing a large flow area for circulation between the flow passage 22 and the annulus 16, and is further capable of reliably and conveniently preventing fluid communication between the flow passage and annulus when desired. The valve 18 of FIGS. 18-21 may further be mechanically opened and closed after being opened and closed by pressure.

In particular, the above disclosure describes a method of controlling flow between an interior flow passage 22 of a tubular string 12 and an annulus 16 external to the tubular string in a subterranean well, with the method including the steps of: constructing a valve 18 for interconnection in the tubular string 12, the valve 18 including at least one opening 20 for providing fluid communication between the interior flow passage 22 and the annulus 16; permitting fluid communication through the opening 20 between the interior flow passage 22 and the annulus 16; then preventing fluid communication through the opening 20 between the interior flow passage 22 and the annulus 16 in response to an application of pressure to the valve 18; and then mechanically displacing a closure device 24 of the valve 18, thereby allowing fluid communication through the opening 20 between the interior flow passage 22 and the annulus 16.

The fluid communication permitting step may be performed in response to an application of pressure to the valve 18 prior to the application of pressure to the valve 18 in the fluid communication preventing step.

The method may include the step of, after the mechanically displacing step, mechanically displacing the closure device 24, thereby preventing fluid communication through the opening 20 between the interior flow passage 22 and the annulus 16.

The mechanically displacing step may include engaging a shifting tool 116 with a profile 120 in the valve 18.

The fluid communication preventing step may include displacing a piston 74 in response to a pressure differential applied across the piston 74, and the mechanically displacing step may include displacing the closure device 24 relative to the piston 74.

The fluid communication permitting step may be performed by applying an increased pressure to the interior flow passage 22 while fluid communication through the opening 20 between the interior flow passage 22 and the annulus 16 is prevented, thereby opening at least one valve device 62 and permitting fluid communication through the valve device 62 and the opening 20 between the interior flow passage 22 and the annulus 16.

The fluid communication preventing step may be performed by applying another increased pressure to the interior flow passage 22 and the annulus 16 while fluid communication through the opening 20 between the interior flow passage 22 and the annulus 16 is permitted, thereby causing fluid communication through the opening 20 between the interior flow passage 22 and the annulus 16 to be prevented.

Another method of controlling flow between an interior flow passage of a tubular string 12 and an annulus 16 external to the tubular string in a subterranean well is described above. The method includes the steps of: applying a pressure differential across a piston 74 of a valve 18 interconnected in the tubular string 12, thereby displacing a closure device 24 of the valve 18; and then displacing the closure device 24 relative to the piston 74, thereby allowing fluid communication between the flow passage 22 and the annulus 16 via at least one opening 20 of the valve 18.

The pressure differential applying step may include preventing fluid communication through the opening 20 between the interior flow passage 22 and the annulus 16 via the opening 20.

The method may also include the step of, prior to the fluid communication preventing step, permitting fluid communication through the opening 20 between the interior flow passage 22 and the annulus 16. The fluid communication permitting step may be performed in response to an application of pressure to the valve 18 prior to the pressure differential applying step.

The method may include the step of, after the closure device 24 displacing step, displacing the closure device 24 relative to the piston 74, thereby preventing fluid communication through the opening 20 between the interior flow passage 22 and the annulus 16.

The closure device 24 displacing step may include engaging a shifting tool 116 with a profile 120 in the valve 18.

The pressure differential applying step may be performed by applying an increased pressure to the interior flow passage 22 while fluid communication through the opening 20 between the interior flow passage 22 and the annulus 16 is prevented, thereby opening at least one valve device 62 and permitting fluid communication through the valve device 62 and the opening 20 between the interior flow passage 22 and the annulus 16.

The method may also include the step of preventing fluid communication between the flow passage 22 and the annulus 16 through the opening 20 by applying another increased pressure to the interior flow passage 22 and the annulus 16 while fluid communication through the opening 20 between the interior flow passage 22 and the annulus 16 is permitted, thereby causing fluid communication through the opening 20 between the interior flow passage 22 and the annulus 16 to be prevented.

Also described in the above disclosure is a valve 18 for use in a subterranean well. The valve 18 includes at least one opening 20 which provides for fluid communication between an exterior of the valve 18 and an interior longitudinal flow passage 22 extending through the valve 18. A closure device 24 selectively permits and prevents flow through the opening 20. A piston 74 biases the closure device 24 to displace, and the closure device 24 is mechanically displaceable relative to the piston 74.

The valve 18 may include at least one valve device 62, with flow through the opening 20 being permitted in response to a pressure differential being applied to the valve device 62. The valve 18 may also include at least another valve device 64, with flow through the opening 20 being prevented in response to another pressure differential being applied to the valve device 64.

The closure device 24 may be displaceable relative to the piston 74 after the piston biases the closure device 24 to displace to a closed position in which fluid communication through the opening 20 is prevented.

Of course, a person skilled in the art would, upon a careful consideration of the above description of representative embodiments of this disclosure, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present disclosure being limited solely by the appended claims and their equivalents.

What is claimed is:

1. A method of controlling flow between an interior flow passage of a tubular string and an annulus external to the tubular string in a subterranean well, the method comprising:

constructing a valve for interconnection in the tubular string, the valve including at least one opening through a sidewall of the valve, whereby the opening provides fluid communication between the interior flow passage and the annulus;

permitting fluid communication between the interior flow passage and the annulus via the opening;

then preventing fluid communication between the interior flow passage and the annulus via the opening in response to an application of pressure to the valve; and then mechanically displacing a closure device from a position that blocks fluid communication through the opening to a position that allows fluid communication between the interior flow passage and the annulus via the opening.

2. The method of claim 1, wherein the permitting is performed in response to an application of pressure to the valve prior to the preventing.

3. The method of claim 1, further comprising then mechanically displacing the closure device, thereby preventing fluid communication between the interior flow passage and the annulus via the opening.

4. The method of claim 1, wherein the displacing further comprises engaging a shifting tool with a profile in the valve.

5. The method of claim 1, wherein the preventing further comprises displacing a piston in response to a pressure differential applied across the piston, and wherein the mechanically displacing further comprises displacing the closure device relative to the piston.

6. The method of claim 1, wherein the permitting is performed by applying a first increased pressure to the interior flow passage while fluid communication between the interior flow passage and the annulus via the opening is prevented, thereby opening at least one first valve device and permitting fluid communication between the interior flow passage and the annulus via the first valve device and the opening.

7. The method of claim 6, wherein the preventing is performed by applying a second increased pressure to the interior flow passage and the annulus while fluid communication between the interior flow passage and the annulus via the opening is permitted, thereby causing fluid communication between the interior flow passage and the annulus via the opening to be prevented.

8. A method of controlling flow between an interior flow passage of a tubular string and an annulus external to the tubular string in a subterranean well, the method comprising:

applying a fluid pressure differential across a piston of a valve interconnected in the tubular string, thereby displacing the piston and a closure device of the valve, wherein the closure device selectively blocks fluid communication between the flow passage and the annulus via at least one opening through a sidewall of the valve; and then displacing the closure device relative to the piston, thereby allowing fluid communication between the flow passage and the annulus via the at least one opening.

9. The method of claim 8, wherein the applying further comprises preventing fluid communication between the interior flow passage and the annulus via the opening.

10. The method of claim 9, further comprising, prior to the preventing, permitting fluid communication between the interior flow passage and the annulus via the opening.

11. The method of claim 10, wherein the permitting is performed in response to an application of pressure to the valve prior to the applying.

12. The method of claim 8, further comprising then displacing the closure device relative to the piston, thereby preventing fluid communication between the interior flow passage and the annulus via the opening.

13. The method of claim 8, wherein the displacing further comprises engaging a shifting tool with a profile in the valve.

14. The method of claim 8, wherein the applying is performed by applying a first increased pressure to the interior flow passage while fluid communication between the interior flow passage and the annulus via the opening is prevented, thereby opening at least one first valve device and permitting fluid communication between the interior flow passage and the annulus via the first valve device and the opening.

15. The method of claim 14, further comprising preventing fluid communication between the flow passage and the annulus via the opening by applying a second increased pressure to the interior flow passage and the annulus while fluid communication between the interior flow passage and the annulus via the opening is permitted, thereby causing fluid communication between the interior flow passage and the annulus via the opening to be prevented.

16. A valve for use in a subterranean well, the valve comprising:

at least one opening through a sidewall of the valve, whereby the opening provides for fluid communication between an exterior of the valve and an interior longitudinal flow passage extending through the valve;

a closure device which selectively blocks fluid communication between the exterior of the valve and the interior longitudinal flow passage via the opening; and a piston which biases the closure device to displace, the closure device being mechanically displaceable relative to the piston following displacement of the closure device by the piston.

17. The valve of claim 16, further comprising at least one first valve device, fluid communication between the exterior of the valve and the interior longitudinal flow passage via the opening being permitted in response to a first pressure differential being applied to the first valve device.

18. The valve of claim 17, further comprising at least one second valve device, fluid communication between the exterior of the valve and the interior longitudinal flow passage via the opening being prevented in response to a second pressure differential being applied to the second valve device.

19. The valve of claim 16, wherein the closure device is displaceable relative to the piston after the piston biases the closure device to displace to a closed position in which fluid communication between the exterior of the valve and the interior longitudinal flow passage via the opening is prevented.

* * * * *